US006787983B2

(12) United States Patent
Yamanobe et al.

(10) Patent No.: US 6,787,983 B2
(45) Date of Patent: Sep. 7, 2004

(54) IMAGE-FORMING APPARATUS

(75) Inventors: Masato Yamanobe, Machida (JP); Fumio Kishi, Aikawa-machi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/041,639

(22) Filed: Mar. 13, 1998

(65) Prior Publication Data

US 2003/0137235 A1 Jul. 24, 2003

(30) Foreign Application Priority Data

Mar. 14, 1997 (JP) ..... 9-061148

(51) Int. Cl.[7] ..... H01J 1/30

(52) U.S. Cl. ..... 313/495; 313/497; 313/422; 313/479; 315/169.4; 315/63

(58) Field of Search ..... 313/495, 497, 313/422, 479, 326, 512, 633, 635, 311; 315/169.4, 56, 61, 63; 345/75

(56) References Cited

U.S. PATENT DOCUMENTS 3,731,135 A 5/1973 Iadicicco et al. ..... 315/31 R
5,760,535 A 6/1998 Moyer et al. ..... 313/309

FOREIGN PATENT DOCUMENTS

| | | |
|---|---|---|
| EP | 0 721 195 | 7/1996 |
| JP | 31-196455 | 8/1991 |
| JP | 4-163833 | 6/1992 |
| JP | 5-190077 | 7/1993 |
| JP | 7-235255 | 9/1995 |
| JP | 8-180821 | 7/1996 |

*Primary Examiner*—Ashok Patel
(74) *Attorney, Agent, or Firm*—Fitzpatrick, Cella, Harper & Scinto

(57) ABSTRACT

An image-forming apparatus includes an envelope, an electron source and an image-forming member arranged within the envelope, as well as an electron source drive circuit. An electroconductive member is arranged on the inner wall surface of the envelope between the electron source and the image-forming member. An electric current flow path A is formed as extending between the electroconductive member and the ground without passing through any of the electron source and the drive circuit. The electric current flow path A has a resistance lower than the resistance of another electric current flow path B extending between the electroconductive member and the ground by way of the electron source or the drive circuit.

26 Claims, 13 Drawing Sheets

IMAGE-FORMING APPARATUS

BACKGROUND OF THE INVENTION

1. Field of the Invention

This invention relates to an image-forming apparatus such as an image display apparatus comprising an electron source.

2. Related Background Art

CRTs (cathode ray tubes) are typical image-forming apparatus that utilize electron beams and have been used widely.

In recent years, flat type display apparatus using liquid crystal have been gaining popularity, and gradually replacing CRTs. However, they are not emission type and accompanied by a number of problems including the need of a back light, and hence there has been a strong demand for emission type display apparatus. While plasma displays are commercially available currently as emission type displays, they are based on a principle different from CRTs for light emission and are not comparable in terms of the contrast of the displayed image and the coloring performance of the apparatus. Meanwhile, efforts have been paid for research and development in the field of realizing a flat type image-forming apparatus by arranging a plurality of electron-emitting devices that is comparable with a CRT in terms of the quality of the displayed image. For example, Japanese Patent Application Laid-Open No. 4-163833 discloses a flat type electron beam image-forming apparatus realized by containing linear thermionic cathodes and complex electrode structures in a vacuum envelope.

With an image-forming apparatus comprising an electron source, the electron beams emitted from the electron source to strike an image-forming member can partly collide with the inner wall of the vacuum envelope to make it emit secondary electrons and become charged up to raise the electric potential at the local areas of the inner wall hit by electron beams. Then, the vacuum envelope shows a distorted potential distribution to produce not only unstable electron beam trajectories but also internal electric discharges to degrade and eventually destroy the apparatus.

The charged up areas come to show a raised electric potential and draw electrons, which by turn further raise the potential of the areas until they come to discharge electrons along the inner wall of the vacuum envelope. Known methods of preventing charge-ups and subsequent discharges from taking place on the inner wall of the vacuum envelope include forming an anti-charge film having an appropriate impedance on the inner wall of the vacuum envelope. Japanese Patent Application Laid-Open No. 4-163833 discloses an image-forming apparatus comprising an electroconductive layer of a high impedance electroconductive material arranged on the lateral sides of the inner wall of the glass envelope of the apparatus.

However, a flat type electron beam image-forming apparatus as described in Japanese Patent Application Laid-Open No. 4-163833 has a considerable depth because the glass envelope of the apparatus contains specifically designed structures including horizontal and vertical deflecting electrodes in it. On the other hand, there is a demand for electron beam image-forming apparatus to be used as portable information processing terminals that are as thin and light weight as a liquid crystal display.

In line with the efforts for realizing very thin image-forming apparatus, the applicant of the present patent application has achieved a number of improvements for surface conduction electron-emitting devices and image-forming apparatus comprising such devices. For example, Japanese Patent Application Laid-Open No. 7-235255 describes an electron-emitting device having a simple configuration. Such devices can be arranged over a relatively large area in large numbers to realize a very thin electron beam image-forming apparatus without using complex structures such as electrode structures.

In an image-forming apparatus of the type under consideration, a voltage is applied between the electron source and the image-forming member to accelerate electrons. If ordinary fluorescent bodies are used for the image-forming member, this voltage is desirably raised at least to a level of several kV in order to provide the emitted light with a desired coloring effect.

Then, in a very thin image-forming apparatus, the risk of electric discharge rises high because the inner wall of the vacuum envelope has only a short length between the image-forming member and the electron source.

More specifically, as a voltage is applied between the image-forming member and the electron source to accelerate electrons, a strong electric field is generated along the inner wall of the vacuum envelope particularly when the inner wall of the vacuum envelope has only a short length between the image-forming member and the electron source. As described earlier, the electron beams emitted from the electron source can partly collide with the inner wall of the vacuum envelope to make it emit secondary electrons and become charged up to raise the electric potential at the local areas of the inner wall hit by electron beams. Then, some of the secondary electrons accelerated by the strong electric field can strike the inner wall of the vacuum envelope to give rise to recurrence of the charge-up and the emission of secondary electrons.

Thus, there exists a need for improving image-forming apparatus if they are to be made ever thinner because of the risk of electric discharge.

If such an electric discharge takes place along the inner wall of the vacuum envelope, a large electric current temporarily appears and mainly flows into the electron source and then down to the ground through the wires arranged in the electron source.

Then, if the electric current flows through all or part of the electron-emitting devices of the electron source with an intensity that exceeds the allowable limit for the normal operation of driving the devices, their performance can become degraded and, in some cases, some of the devices can become destroyed. Then, the image displayed on the image-forming apparatus can be lost, if partly, to remarkably degrade the quality of the image and make the image-forming apparatus no longer operational.

Additionally, the electron source drive circuit can also be damaged if the electric current produced by the electric discharge flows into the circuit by way of the wires connected thereto.

SUMMARY OF THE INVENTION

In view of the above identified technological problems of known image-forming apparatus of the type under consideration, it is therefore the principal object of the present invention to provide an image-forming apparatus comprising an electron source that can minimize the risk of degradation and damage of the electron source and the electron source drive circuit if electric discharges occur in the apparatus.

According to the invention, there is provided an image-forming apparatus comprising an envelope, an electron source and an image-forming member arranged within the envelope and an electron source drive circuit, an electroconductive member arranged on the inner wall surface of the envelope between the electron source and the image-forming member and an electric current flow path A extending between the electroconductive member and the ground without passing through any of the electron source and the drive circuit and the electric current flow path A has a resistance lower than the resistance of another electric current flow path B extending between the electroconductive member and the ground by way of the electron source or the drive circuit.

DETAILED DESCRIPTION OF THE PREFERRED EMBODIMENTS

Figure 1:
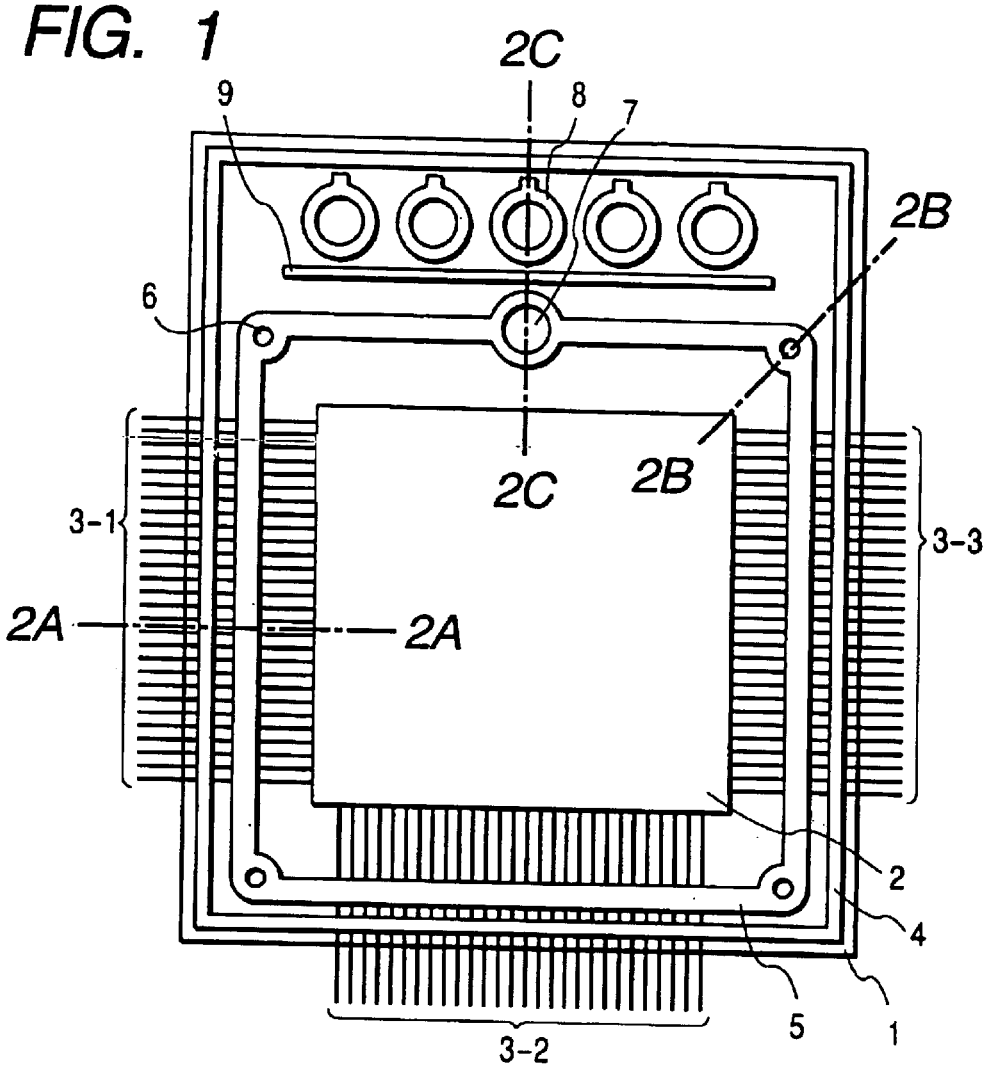
FIG. 1 is a schematic plan view of an embodiment of an image-forming apparatus according to the invention, showing the arrangement of the rear plate and the support frame.

According to the invention, there is provided an image-forming apparatus comprising an envelope, an electron source and an image-forming member arranged within the envelope and an electron source drive circuit, an electroconductive member arranged on the inner wall surface of the envelope between the electron source and the image-forming member and an electric current flow path A extending between the electroconductive member and the ground without passing through any of the electron source and the drive circuit and the electric current flow path A has a resistance lower than the resistance of another electric current flow path B extending between the electroconductive member and the ground by way of the electron source or the drive circuit.

Now, the present invention will be described in greater detail by way of preferred embodiments.

A preferred embodiment of image-forming apparatus according to the invention comprises a vacuum envelope formed by a pair of oppositely disposed flat plates and lateral members arranged between the flat plates, an electron source arranged on the inner surface of one of the pair of flat plates and having a plurality of electron-emitting devices arranged thereon (the flat plate carrying the electron source being referred to as rear plate hereinafter), an image-forming member arranged vis-a-vis the electron source on the inner surface of the other flat plate (the flat plate carrying the image-forming member being referred to as face plate hereinafter), a voltage being applied between the electron source and the image-forming member to accelerate electrons, and a low resistance electric conductor arranged around the electron source on the rear plate and connected to the ground by way of a low impedance electric current flow path (referred to as "ground connection line" hereinafter). While it is preferable that the ground connection line has an impedance as small as possible, the most important requirement to be met by the ground connection line is that, if an electric discharge occurs, the discharge current generated by the electric discharge mostly flows to the ground through the low resistance electric conductor and the ground connection line to sufficiently reduce the electric current flowing into the electron source.

To what extent the discharge current flows through the low resistance electric conductor and the ground connection line depends on the ratio of the impedance of the electric current flow path to that of the other electric current flow paths (represented by Z and Z' respectively hereinafter) and, since the impedance varies as a function of frequency, it is necessary to look into the frequency components of the electric discharge. As a result of experiments conducted to observe the electric discharge occurring along the inner wall of the vacuum envelope of a flat type electron beam image-forming apparatus, it was found that, while the electric discharge typically lasts for several microseconds, a large discharge current can flow only for less than a tenth of the duration of the electric discharge or about 0.1 microseconds. Therefore, Z should be sufficiently smaller than Z' for a frequency less than 10 MHz. The frequency components greater than 10 MHz diminish gradually but such frequency components typically show a quick rising of electric discharge and include those close to 1 GHz. Therefore, Z should be sufficiently smaller than Z' for a frequency less than 1 GHz in order to reliably avoid damages due to an electric discharge.

As will be described hereinafter, this requirement is satisfactorily met when the resistance of the ground connection line is less than $1/10$, preferably less than $1/100$, of the resistance of any other electric current flow paths.

Figure 11A:
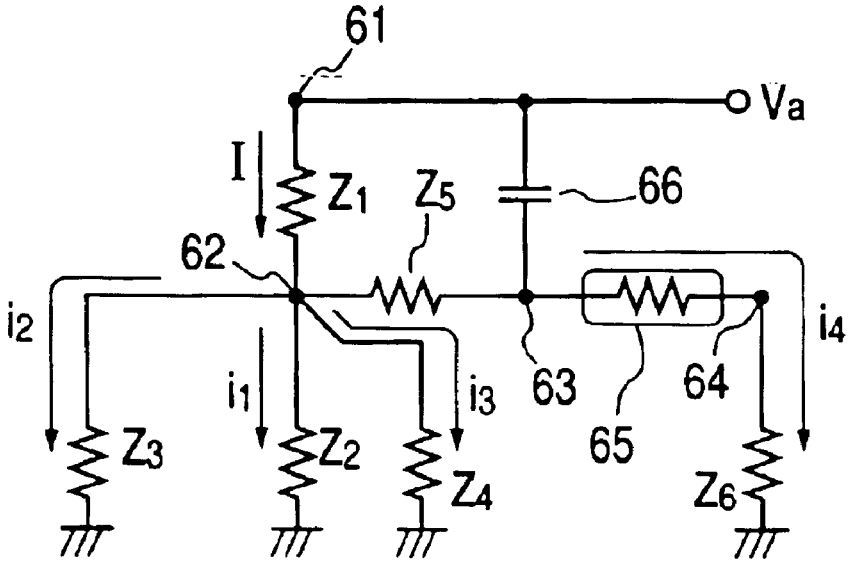
FIG. 11A is a circuit diagram of an equivalent circuit to be used for illustrating the effect of the present invention.
Figure 11B:
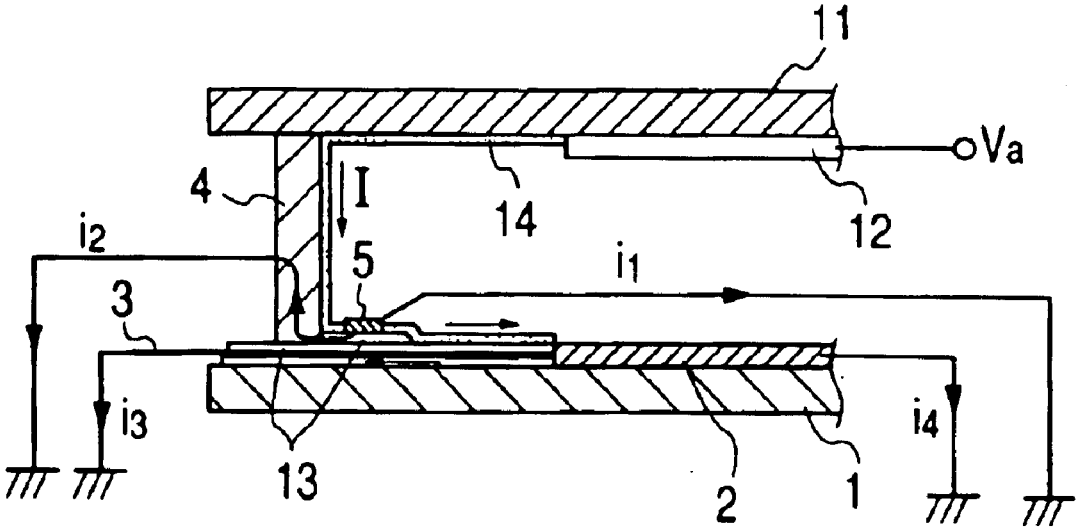
FIG. 11B is a schematic partial cross sectional view of an image-forming apparatus according to the invention, illustrating the correspondence with the equivalent circuit of FIG. 11A.

FIG. 11A is a circuit diagram of a simplified equivalent circuit illustrating the electric currents that appear when an electric discharge occurs in an image-forming apparatus according to the invention. FIG. 11B is a schematic partial cross sectional view of an image-forming apparatus corresponding to the equivalent circuit of FIG. 11A, also showing the electric currents that appear when an electric discharge occurs in the apparatus. In FIG. 11B, there are shown a rear plate 1, an electron source 2, electron source drive wires 3, a support frame 4, a low resistance electric conductor 5, a face plate 11, an image-forming member 12 and an insulating member 13. The insulating member 13 may be an insulation layer formed by printing or an insulator panel of glass or ceramic. The insulating member 13 may be entirely produced by applying glass paste by means of a printing technique and then baking the paste. Alternatively, a glass or ceramic plate may be used as part of the insulating member 13 in order to provide the latter with a sufficient degree of insulation and prevention of dielectric breakdown. In this embodiment, an anti-charge film 14 is arranged on the inner wall of the vacuum envelope. Note that, in FIG. 11A, point 61 corresponds to the image-forming member 12 and point 62 corresponds to the low resistance electric conductor 5, whereas point 65 represents an electron-emitting device of the electron source and points 63 and 64 represent the respective opposite electrodes of the electron-emitting device. While the electron source normally comprises a plurality of electron-emitting devices, only a single device is shown in FIG. 11A for the purpose of simplicity. Reference numeral 66 denotes the capacitance between the image-forming member 12 and the electron source 2.

Reference symbol $Z_1$ denotes the impedance between the image-forming member 12 and the low resistance electric conductor 5, which is relatively large due to the anti-charge film 14 under normal conditions (where there is no electric charge) but falls effectively and remarkably to cause electric current I to flow once an electric discharge occurs. Reference symbol $Z_2$ denotes the impedance for electric current $i_1$ flowing from the low resistance electric conductor 5 itself down to the ground. Reference $Z_3$ denotes the impedance for electric current $i_2$ flowing through the insulation layer, the glass of the vacuum envelope, the frit glass used for bonding and the supports of the image-forming apparatus down to the ground, although this electric current can be made very small and negligible when a sufficiently large resistance is selected for the insulation layer. Reference symbol $Z_4$ denotes the impedance for electric current $i_3$ flowing through the anti-charge film 14 into the electron source and then further down to the ground through the electron source drive wires 3. Reference symbol $Z_5$ denotes the impedance for electric current $i_4$ flowing through the anti-charge film 14 into the electron source and then into the electron-emitting device 2. Reference $Z_6$ denotes the impedance for the electric current (denoted also by $i_4$) flowing through the electron-emitting device 2 and then down to the ground by way of the line at the opposite end of the device 2. Note that the equivalent circuit of FIG. 11A is a simplified expression of the embodiment showing only the elements that are most significant for the purpose of the invention, although, rigorously speaking, the embodiment involves complex factors such as the fact that the electron source drive wires 3 are connected to an electron source drive circuit and a capacitive coupling may exist between any two components.

For the purpose of the invention, once a discharge current appears and flows into the low resistance electric conductor, most of it should be made to flow to the ground (as electric current $i_1$) to sufficiently reduce the remaining currents $i_2$, $i_3$ and $i_4$. Note that, of the electric currents, the electric current $i_4$ is the one that can damage the electron-emitting device. While not pointed out above, the electric current $i_2$ can damage the vacuum envelope and the frit glass in the apparatus, although it can be made low by selecting a sufficiently large resistance for the insulation layer as described above. Thus, the impedance $Z_2$ corresponds to the impedance Z described earlier and the composite impedance of $Z_3$ through $Z_6$ corresponds to the impedance Z' in the earlier description. While a small value of the ratio (Z/Z') is effective for the purpose of the invention, a value of $(Z/Z') \leqq 1/10$ is required for frequencies below 10 MHz. A value of $(Z/Z') \leqq 1/100$ will make the effect of the invention more reliable. Preferably, the relationship of $(Z/Z') \leqq 1/10$ holds true for frequencies below 1 GHz.

While the anti-charge film is arranged on the inner wall of the vacuum envelope in the above description and such an arrangement is effective for reducing the possibility of appearance of charge-ups and hence provides a preferred mode of carrying out the invention, the anti-charge film may not necessarily be arranged in such a way. While the anti-charge film should show a certain degree of electroconductivity because it is useless if it shows a large sheet resistance, a large electric current can flow between the image-forming member and the low resistance electric conductor to increase the power consumption of the apparatus under normal conditions if the sheet resistance is too small. Therefore, it should have a sheet resistance as large as possible within a limit for keeping it effective as an anti-charge film. Although the sheet resistance may vary depending on the configuration of the image-forming apparatus, it is preferably found within a range between $10^8$ and $10^{10}$ Ω/□.

The low resistance electric conductor of an image-forming apparatus according to the invention is arranged to totally surround the electron source in order to make it operate most reliably, although it may be arranged in many different ways. For example, it may be arranged only on the side(s) of the electron source that can easily give rise to electric discharges. If the momentum of some of the electrons emitted from the electron-emitting devices of the electron source has a component directed in a specific direction along the surface of the rear plate, most of the electrons reflected and scattered by the image-forming member will collide with a portion of the inner wall of the vacuum envelope located at the end of the specific direction so that an electric discharge will most probably occur at that portion. Therefore, the low resistance electric conductor will be highly effective if it is arranged only on the side of the electron source where that portion is located.

Of the ground connection line of an image-forming apparatus according to the invention, the portion that connects the inside and the outside of the vacuum envelope (hereinafter referred to as "ground connection terminal") may take various forms provided that it shows a sufficiently low impedance. For example, a wire may be arranged for the ground connection line without difficulty on the rear plate between the low resistance electric conductor and an end of the rear plate and then made to pass between the rear plate and the support frame that are bonded to each other by frit glass. While the wire preferably has a large width and a large height from the viewpoint of reducing the impedance of the wire, it can obstruct the assemblage of vacuum envelope if it is too high. While the wire may have a width slightly less than that of the rear plate along which the wire is arranged, a large capacitance can be produced between the wire and the electron source drive wires to adversely affect the operation of driving the electron source if the electron source drive wires are arranged on the wire having such a large width with an insulation layer interposed therebetween to form a multilayer structure. Then, measures has to be taken to eliminate such a large capacitance. It may be preferable to arrange the ground connection terminal in an area where no electron source drive wire is located.

Although the use of a wide wire to reduce the impedance of the ground connection terminal is also effective for preventing part of the discharge current from leaking into and damaging the frit glass, this effect can be made more reliable when the ground connection terminal is realized in the form of a sufficiently large metal rod running through a through hole formed in the face plate or the rear plate and coated with an insulating material such as alumina or ceramic that does not allow any ionic current to flow therethrough.

It is preferable from the design point of view to make both the high voltage connection terminal for connecting the image-forming member to a high voltage source and the above described ground connection terminal of an image-forming apparatus run through a through hole formed in the rear plate when applying the apparatus to a TV receiving set or the like because the connection with the high voltage source and the ground are then found on the rear side of the image-forming apparatus, although measures may have to be taken against electric discharges that can take place on the surface of the insulation coat due to the high voltage applied between the image-forming member and the rear plate through the insulator coat of the high voltage connection terminal. A low resistance electric conductor will also have to be arranged around the through hole of the high voltage connection terminal and electrically connected to the low resistance electric conductor arranged around the electron source. Alternatively, the two low resistance electric conductors may be made into integral parts of a single conductor.

Now, a first embodiment of image-forming apparatus according to the invention will be described by referring to FIGS. 1 and 2A through 2C. FIG. 1 is a schematic plan view of the first embodiment, showing the internal arrangement by removing the face plate. Referring to FIG. 1, reference numeral 1 denotes a rear plate designed to operate as the substrate of the electron source and made of a material selected from soda lime glass, soda lime sheet glass coated on the surface with an $SiO_2$ layer, glass containing Na to a reduced concentration, quartz glass and ceramic according to the conditions under which it is used. Note that a separate substrate may be used for the electron source and bonded to the rear plate after preparing the electron source. Reference numeral 2 denotes an electron source region where a plurality of electron-emitting devices such as surface conduction electron-emitting devices are arranged and wired appropriately so that they may be driven appropriately according to the application of the apparatus. Reference symbols 3-1, 3-2 and 3-3 denote wires to be used for driving the electron source, which are partly drawn to the outside of the vacuum envelope and connected to an electron source drive circuit (not shown). Reference numeral 4 denotes a support frame held between the rear plate 1 and the face plate (not shown) and bonded to the rear plate 1 by means of frit glass. The electron source drive wires 3-1, 3-2 and 3-3 are buried into frit glass at the junction of the support frame 4 and the rear plate 1 before they are drawn to the outside of the vacuum envelope. Reference numeral 5 denotes a low resistance electric conductor that characterizes an image-forming apparatus according to the present invention and is arranged around the electron source 2. An insulation layer (not shown) is arranged between the low resistance electric conductor 5 and the electron source drive wires 3-1, 3-2 and 3-3. The low resistance electric conductor 5 is provided at the four corners thereof with respective broad abutting sections 6 adapted to abut the terminals of a ground connection line. Reference numeral 7 denotes a through hole for allowing a high voltage lead-in terminal to run therethrough in order to feed the image-forming member on the face plate (not shown) with a high voltage. Otherwise, a getter 8 and a getter shield plate 9 are arranged within the image-forming apparatus if necessary.

Figure 2A:
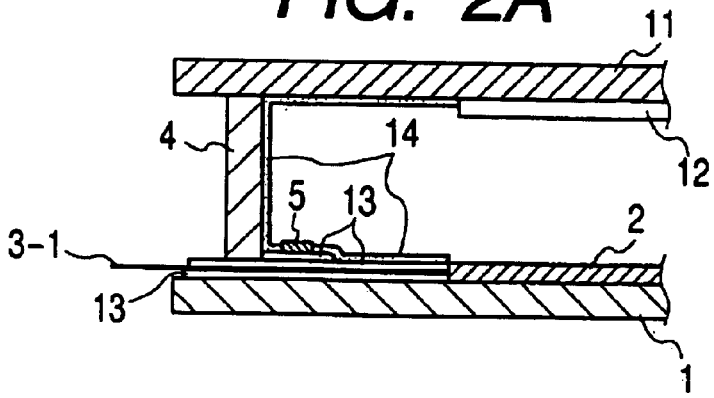
FIGS. 2A, 2B and 2C are schematic partial cross sectional views of the embodiment of FIG. 1 taken along lines 2A—2A, 2B—2B and 2C—2C in FIG. 1 respectively.
Figure 2B:
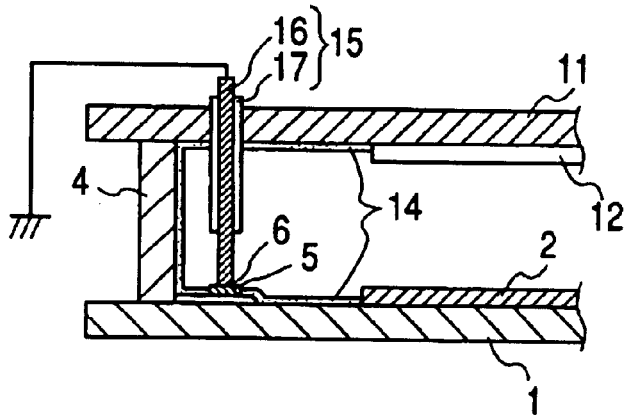
Figure 2C:
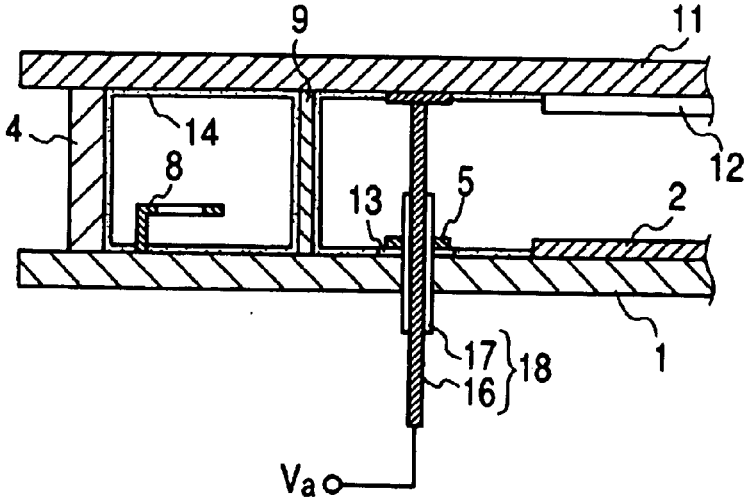

FIGS. 2A, 2B and 2C show schematic partial cross sectional views of the embodiment of FIG. 1 taken along lines 2A—2A, 2B—2B and 2C—2C in FIG. 1 respectively. In FIG. 2A, there are shown the face plate 11, the image-forming member 12 which is formed from a fluorescent film and a metal film (e.g., of aluminum) and also referred to as metal back, the insulation layer 13 which is arranged only when the provision of such a layer is necessary and an anti-charge film 14 formed on the inner wall of the vacuum envelope. Note that the anti-charge film 14 is formed not only on the glass layer of the inner wall of the vacuum envelope but also on the image-forming member 12 and the electron source 2 if desired. An anti-charge film arranged on the electron source 2 can also prevent charge-ups from taking place.

As pointed out above, any leak currents that can appear among any of the electron-emitting devices and the wires of the electron source does not give rise to any problem so long as the sheet resistance of the anti-charge film is found between $10^8$ and $10^{10}$ Ω/□.

The anti-charge film may be made of any material so long as it provides a desired sheet resistance and a sufficient degree of stability. For example, a film obtained by dispersing fine graphite particles to an appropriate density may be used. Since such a film can be made sufficiently thin, a thin film of fine graphite particles arranged on the metal back of the image-forming member does not show any harmful effect such as reducing the number of electrons striking the fluorescent bodies of the image-forming member to make them emit light. Additionally, since such a film is less apt to give rise to elastic scattering of electrons when compared with the material of the metal back which is typically aluminum, it can be effective to reduce the number of scattering electrons which may cause charge-ups.

When an electric discharge occurs along the inner wall of the vacuum envelope with the above arrangement, the generated discharge current flows into the low resistance electric conductor 5 by way of the image-forming member 12 being applied with a high voltage and the inner wall of the vacuum envelope and then most of the current flows down to the ground through the low impedance ground connection line so that the possible flow of electricity into the electron source 2 through the wires 3-1 and further to the ground through the glass and other members of the vacuum envelope can be effectively avoided.

In FIG. 2B, the ground connection terminal 15 is connected to the abutting section 6 of the low resistance electric conductor 5. The ground connection terminal is typically comprises a conductor 16 and an insulator 17, of which the conductor 16 is a metal rod of Ag or Cu having a sufficiently large cross section (e.g., an Ag rod having a diameter of 2 mm or an electric resistivity as small as about 5 mΩ per centimeter or a Cu or Al rod having an electric resistivity of about the same level) and coated with an Au coat layer arranged to reduce the contact resistance of the surface. Preferably, the abutting section 6 of the low resistance electric conductor 5 is also coated with Au or made of Au to reduce the contact resistance.

Then, the entire electric resistance of the current flow path from the low resistance electric conductor 5 down to the ground can be reduced to a level as low as less than 1 Ω by connecting the connector of the ground connection terminal 15 to the ground.

On the other hand, the coefficient of self-induction of the ground connection line can be reduced to less than $10^{-6}$H by reducing the distance between the ground connection terminal 15 and the ground. Thus, the impedance can also be reduced to less than about 10 Ω for the frequency component of 10 MHz. Then, the impedance for the frequency component of 1 GHz will be 1 kΩ at most.

Assume here that there is no ground connection line. Then, the electric current between the low resistance electric conductor 5 and the ground mainly flows through the surface of the rear plate (or the anti-charge film if it is arranged) and goes into the electron source before it further flows down to the ground by way of the electron source drive wires. Referring to FIG. 11A, this flow path corresponds to those of the electric currents $i_3$ and $i_4$ and the dominant factor of the impedance of this flow path will be the resistance of the electric current flow path through the surface of the rear plate or the anti-charge film. If the electron source has a peripheral length of 100 cm and is separated from the low resistance electric conductor by 1 cm and the anti-charge film has a sheet resistance of $10^8$ Ω/□, the electric current will meet a resistance of about 1 MΩ assuming that it flows evenly through the anti-charge film. This value is sufficiently large if compared with the impedance of the ground connection line.

The electric resistance of this part will be even greater if there is no anti-charge film.

If, on the other hand, the distance separating the electron source and the low resistance electric conductor is reduced to about 1 mm, then, the resistance of this part will be 1/10 of the above cited value. If the value is further reduced to a fraction of 1/10 of the above cited value, the electric resistance between the low resistance electric conductor and the electron source will be somewhere around 10 kΩ. This will be an extreme case and the actual value will be greater than this. The resistance of this part will dominate the impedance of the flow path of the electric current between the low resistance electric conductor and the ground when the ground connection line does not exist. Thus, the impedance Z' of the electric current flow path is substantially equal to the resistance (which will be indicated by R' hereinafter) of the entire flow path, of which the resistance between the low resistance electric conductor and the electron source takes a major part.

If a discharge current flows into the low resistance electric conductor, the ratio of the electric current that flows further from the low resistance electric conductor to the ground by way of the low impedance line to the electric current that flows from the low resistance electric conductor into the electron source by way of the anti-charge film and then down to the ground by way of the electron-emitting devices and the wires of the electron source is equal to the ratio of the reciprocal number of the impedance Z and that of the impedance Z' (≈R'). If R' is ten times greater than Z, then the discharge current due to an electric discharge that flows down to the ground through the electron source will be a fraction of its counterpart when there is no low impedance line.

Of the impedance of the low impedance line, the self-induction component will be about 10 Ω for the frequency of 10 MHz and 1 kΩ for the frequency of 1 GHz. Therefore, if the resistance component (which will be indicated by R hereinafter) is less than 1 kΩ, the impedance Z will be 1 kΩ or less for a frequency range below 1 GHz or less than 1/10 of Z' (≈R). If R is less than 100 Ω, then the impedance Z will be 100 Ω or less for a frequency range below 100 MHz.

It is not possible to define in simple terms the degree of reduction in the electric current flowing into the electron source that can save the electron-emitting devices, the vacuum envelope and the drive circuit from damages when an electric discharge occurs, because the degree can vary significantly depending on the various parameters of individual image-forming apparatus. However, it may be safe to assume that the discharge current that flows into the electron source will show a certain dispersion pattern in statistic terms and, as a rule of thumb, the probability of damaging the electron source can be significantly reduced by reducing the discharge current flowing into the electron source by one or two digits.

While R' is assumed to show a minimal value of 10 kΩ in the above description, a similar effect or an even greater effect can be expected when R' is greater than the above value and R is less than 1/10 or 1/100 of R'.

The low resistance electric conductor 5 may be made of electroconductive carbon such as carbon paste. The electric resistance between the low resistance electric conductor and the ground connection line can be held to about 100 Ω without difficulty by selecting a sufficiently large value for the thickness of the conductor to realize a sufficiently small impedance for the flow path relative to any other electric current flow paths.

The ground connection terminal 15 may be realized in a form other than the one described above. As an alternative, it may be led out to the rear side of the rear plate.

In FIG. 2C, reference numeral 18 denotes a high voltage feed terminal for feeding the image-forming member 12 with a high voltage (anode voltage Va). As in the case of the ground connection terminal, the feed terminal 18 comprises a conductor 16 and an insulator 17. With this arrangement, electric discharges can occur along the lateral surface of the insulator 17 and, therefore, the low resistance electric conductor 5 is preferably made to surround the periphery of the through hole 7 as shown in FIG. 1 in order to prevent the discharge current from flowing into the electron source 2 and the vacuum envelope.

The high voltage wiring may alternatively be drawn out to the side of the face plate. This arrangement is advantageous from the anti-discharge point of view because the insulator is not subjected to a high voltage and hence electric discharges would not occur frequently.

The anti-charge film 14 is formed not only on the inner wall surfaces of the face place, the support frame and the rear plate but also on the getter shield plate 9.

Electron-emitting devices of any type may be used for the electron source 2 so long as they are adapted to an image-forming apparatus in terms of electron-emitting performance and the size of the devices. Electron-emitting devices that can be used for the purpose of the invention include thermionic electron-emitting devices and cold cathode devices such as field emission devices, semiconductor electron-emitting devices, MIM type electron-emitting devices and surface conduction electron-emitting devices.

Figure 8A:
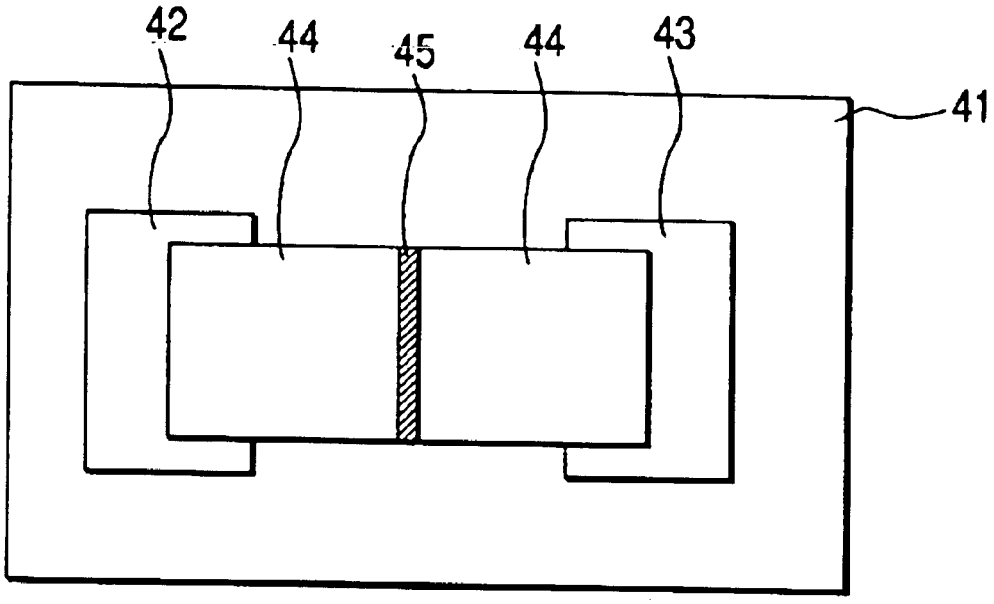
FIGS. 8A and 8B are a plan view and a cross sectional view schematically showing a surface conduction electron-emitting device that can be used for the purpose of the invention.
Figure 8B:
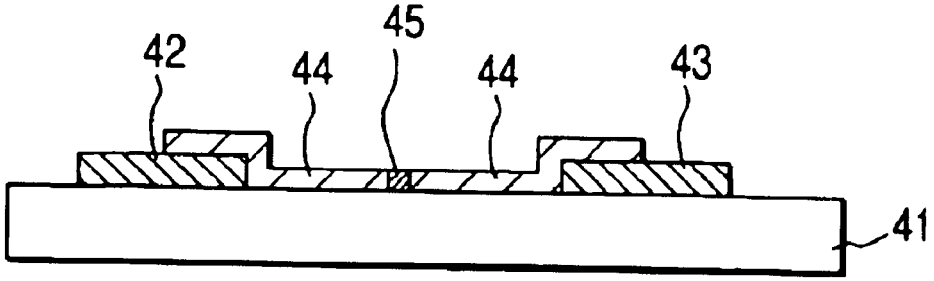

Surface conduction electron-emitting devices of the type as disclosed in Japanese Patent Application Laid-Open No. 7-235255 filed by the applicant of the present patent application are advantageously used in the following embodiments. FIGS. 8A and 8B schematically illustrates a surface conduction electron-emitting device disclosed in the above patent document. FIG. 8A is a plan view and FIG. 8B is a cross sectional view.

Referring to FIGS. 8A and 8B, the device comprises a substrate 41, a pair of device electrodes 42 and 43, an electroconductive film 44 connected to the device electrodes. An electron-emitting region 45 is formed in part of the electroconductive film. More specifically, the electron-emitting region 45 is an electrically highly resistive area produced in the electroconductive film 44 by locally destroying, deforming or transforming the electroconductive 44 to show a fissure there in a process referred to energization forming. Then, electrons will be emitted from the fissure and its vicinity.

Figure 5A:
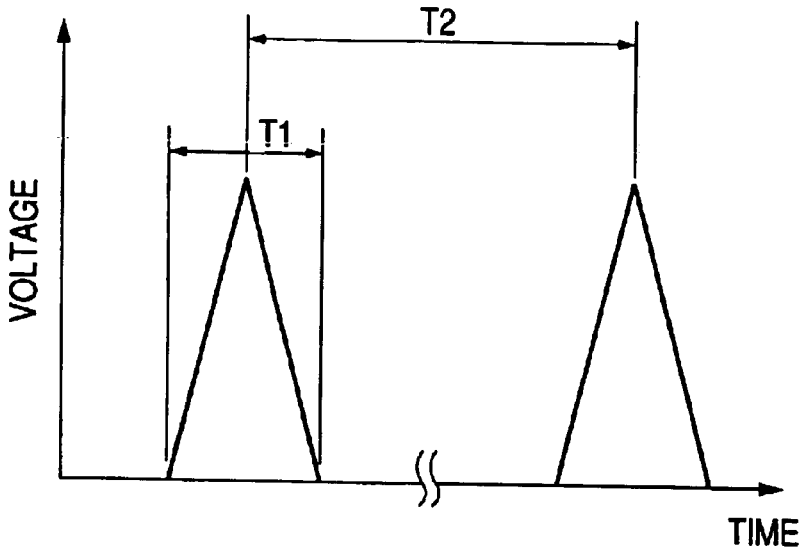
FIGS. 5A and 5B are graphs showing two alternative pulse voltages that can be used for forming the electron-emitting region of a surface conduction electron-emitting device for the purpose of the invention.
Figure 5B:
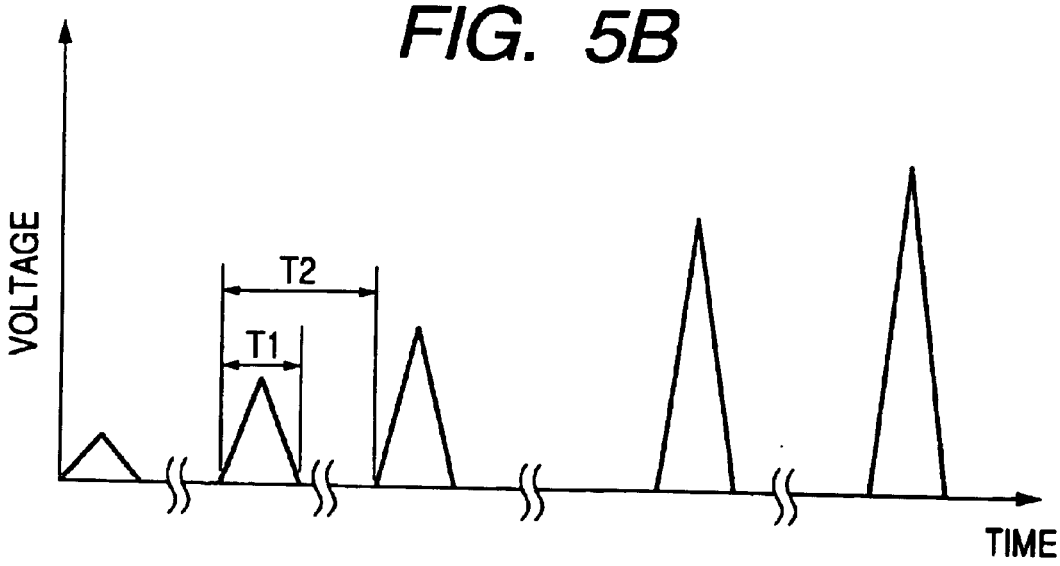

An energization forming process is a process where a voltage is applied to the pair of device electrodes 42 and 43. The voltage to be used for energization forming preferably has a pulse waveform. A pulse voltage having a constant height or a constant peak voltage may be applied continuously as shown in FIG. 5A or, alternatively, a pulse voltage having an increasing height or an increasing peak voltage may be applied as shown in FIG. 5B. The waveform is not limited to a triangular shape. Rectangular or other shapes may also be used.

After the energization forming operation, the device is subjected to an "activation process".

In an activation process, a pulse voltage may be repeatedly applied to the device in an atmosphere containing organic substances to deposit a substance containing carbon or a carbon compound as principle ingredient on and/or around the electron-emitting region. As a result of the activation process, both the electric current that flows between the device electrodes (device current If) and the electric current generated by electrons emitted from the electron-emitting region (emission current Ie) rises.

The electron-emitting device that has been treated in an energization forming process and an activation process is then preferably subjected to a stabilization process. This is a process for removing any organic substances remaining near the electron-emitting region in a vacuum envelope. The exhausting equipment to be used for this process preferably does not involve the use of oil so that it may not produce any evaporated oil that can adversely affect the performance of the treated device. Thus, the use of an exhausting equipment comprising a sorption pump and an ion pump may be a preferable choice.

The partial pressure of the organic gas in the vacuum envelope is such that no additional carbon or a carbon compound would not be deposited on the device and preferably lower than $1.3\times10^{6}$ Pa and more preferably lower than $1.3\times10^{8}$ Pa. The vacuum envelope is preferably evacuated during heating the entire envelope so that organic molecules adsorbed by the inner wall of the vacuum envelope and the electron-emitting device may also be easily eliminated. While the vacuum envelope is preferably heated to 80 to 250° C., particularly higher than 150° C., for a period as long as possible, other heating conditions may alternatively be selected depending on the size and the profile of the vacuum envelope and the configuration of the electron-emitting device in the envelope as well as other considerations. The pressure in the vacuum envelope needs to be made as low as possible and is preferably lower than $1\times10^{5}$ Pa and more preferably lower than $1.3\times10^{6}$ Pa.

Preferably, the atmosphere after the completion of the stabilization process is maintained for driving the electron-emitting device, although lower pressure may alternatively be used without damaging the stability of operation of the electron-emitting device or the electron source if the organic substances in the envelope are sufficiently removed.

By using such an atmosphere, the formation of any additional deposit of carbon or a carbon compound can be effectively suppressed and the moisture and the oxygen adsorbed by the vacuum envelope and the substrate can be eliminated to consequently stabilize the device current If and the emission current Ie.

Figure 9:
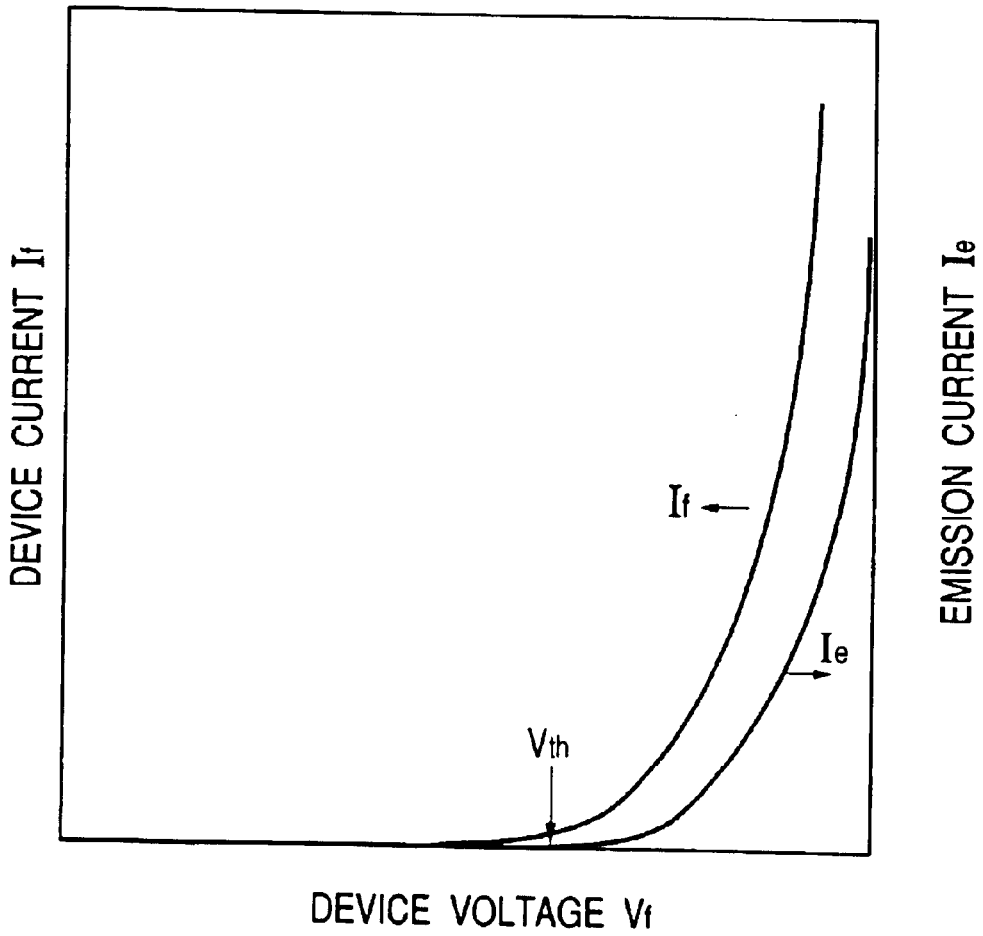
FIG. 9 is a graph showing typical electric characteristics of the surface conduction electron-emitting device of FIGS. 8A and 8B.

FIG. 9 shows a graph schematically illustrating the relationship between the device voltage Vf and the emission current Ie and the device current If of a surface conduction electron-emitting device prepared in a manner as described above. Note that different units are arbitrarily selected for Ie and If in FIG. 9 in view of the fact that Ie has a magnitude by far smaller than that of If. Also note that both the vertical and transversal axes of the graph represent a linear scale.

Referring to FIG. 9, the electron-emitting device shows a sudden and sharp increase in the emission current Ie when the device voltage Vf applied thereto exceeds a certain level (which is referred to as a threshold voltage hereinafter and indicated by Vth in FIG. 9), whereas the emission current Ie is practically undetectable when the applied voltage is found lower than the threshold value Vth. Differently stated, the electron-emitting device is a non-linear device having a clear threshold voltage Vth for the emission current Ie. Thus, an image-forming apparatus can be realized by two-dimensionally arranging a number of electron-emitting devices with an image-forming member disposed vis-a-vis the devices and connecting the electron-emitting device with a matrix wiring system. Then, images can be formed by driving selected ones of the electron-emitting devices to emit electrons by means of a simple matrix drive arrangement and irradiating the image-forming member with electrons.

Figure 10A:
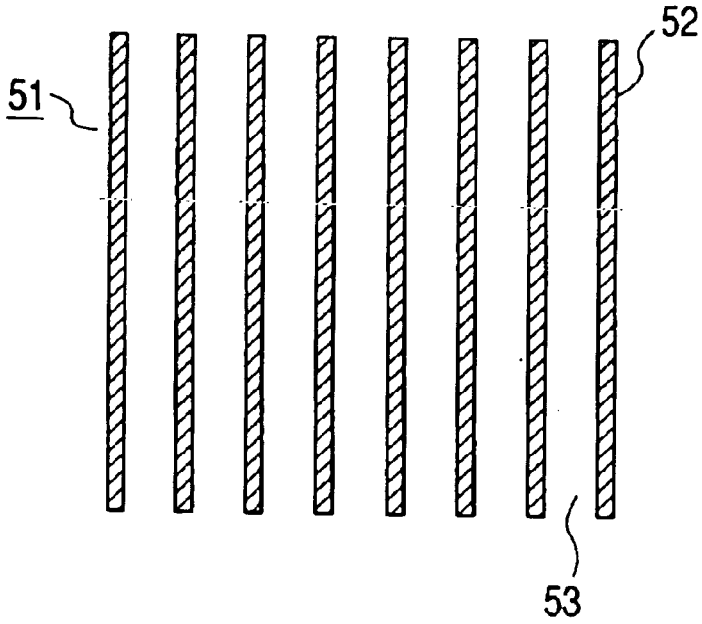
FIGS. 10A and 10B are two typical image-forming members that can be used for the purpose of the invention.
Figure 10B:
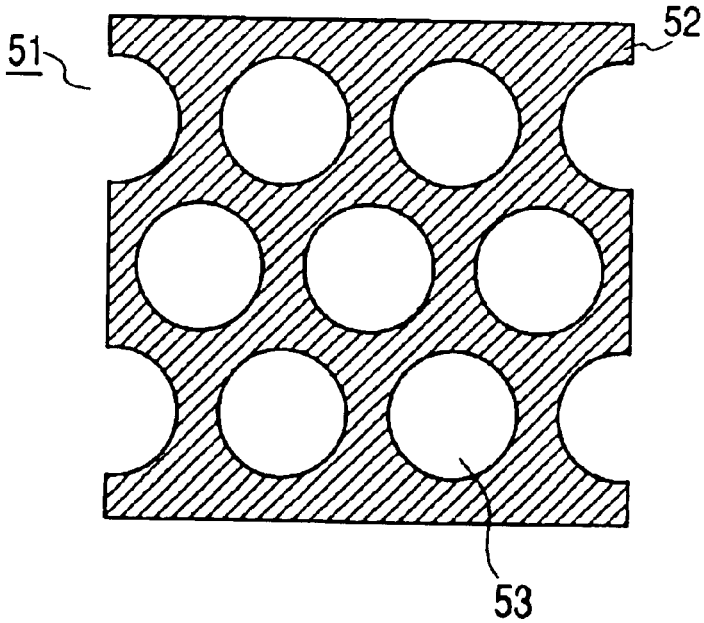

Now, the image-forming member comprising a fluorescent film will be described. FIGS. 10A and 10B schematically illustrate two possible arrangements of fluorescent film. While the fluorescent film 51 comprises only a single fluorescent body if the display panel is used for displaying black and white pictures, it needs to comprise for displaying color pictures black conductive members 52 and fluorescent bodies 53, of which the former are referred to as black stripes or a black matrix depending on the arrangement of the fluorescent bodies. Black stripes or members of a black matrix are arranged for a color display panel between the fluorescent bodies 53 so that any possible mixing of three different primary colors are made less discriminable and the adverse effect of reducing the contrast of displayed images of reflected external light is weakened by blackening the surrounding areas. While graphite is normally used as a principal ingredient of the black stripes, other conductive material having low light transmissivity and reflectivity may alternatively be used.

A precipitation or printing technique is suitably be used for applying a fluorescent material on the face plate 11 regardless of black and white or color display. An ordinary metal back is arranged on the inner surface of the fluorescent film 51. The metal back is provided in order to enhance the luminance of the display panel by causing the rays of light emitted from the fluorescent bodies and directed to the inside of the envelope to turn back toward the face plate 11, to use it as an electrode for applying an accelerating voltage to electron beams and to protect the fluorescent bodies against damages that may be caused when negative ions generated inside the envelope collide with them. It is prepared by smoothing the inner surface of the fluorescent film (in an operation normally called "filming") and forming an Al film thereon by vacuum evaporation after forming the fluorescent film.

A transparent electrode may be formed on outer surface of the fluorescent film 51 of the face plate in order to raise the conductivity of the fluorescent film 51.

Care should be taken to accurately align each set of color fluorescent bodies and an electron-emitting device, if a color display is involved, before the above listed components of the envelope are bonded together.

A thin flat type electron beam image-forming apparatus having a configuration as described above can operate with a remarkably improved reliability. Such a thin flat type image-forming apparatus is made to display image by applying a scan signal and an image signal to the electron-emitting devices connected by means of a matrix wiring arrangement and also a high voltage to the metal back of the image-forming member.

The invention will be described further on by referring to the drawings and by way of examples.

EXAMPLE 1

In this example, an electron source was prepared for an image-forming apparatus by arranging a plurality of surface condition electron-emitting devices on the rear plate of the apparatus that was used as substrate and connecting them by means of a matrix wiring arrangement. The steps of manufacturing the apparatus will be described by referring to FIGS. 3A through 3E and 4.

(Step-a)

After thoroughly cleansing a soda lime glass plate, an $SiO_2$ film was formed thereon to a thickness of 0.5 $\mu$m by sputtering to produce a rear plate 1. Then, a circular through hole 7 (see FIG. 1) for introducing a high voltage terminal was bored through the rear plate to a diameter of 4 mm by means of an ultrasonic boring machine.

Figure 3A:
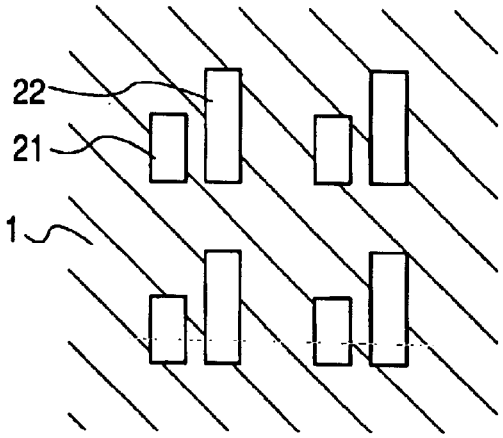
FIGS. 3A, 3B, 3C, 3D and 3E are schematic partial plan views of an image-forming apparatus according to the invention in different manufacturing steps.

Then, a Ti film and an Ni film were sequentially formed to respective thicknesses of 5 nm and 100 nm on the rear plate by sputtering and photolithography to produce a pair of device electrodes 21 and 22 for each electron-emitting device. The device electrodes were separated by 2 $\mu$m from each other (FIG. 3A).

(Step-b)

Figure 3B:
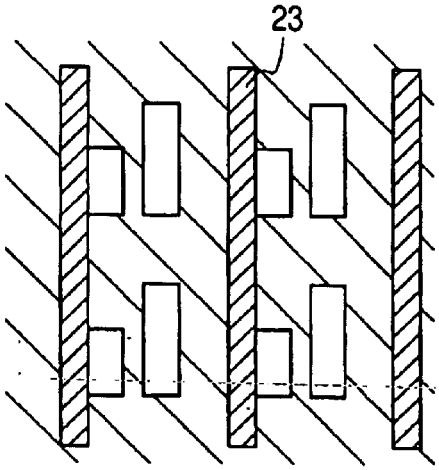

Subsequently, Ag paste was applied to the rear plate to show a predetermined pattern by printing and then baked to produce Y-directional wires 23, which were extended to the outside of the electron source forming region for electron source drive wires 3-2 as shown in FIG. 1. Each of the wires was 100 $\mu$m wide and about 10 $\mu$m thick (FIG. 3B).

(Step-c)

Figure 3C:
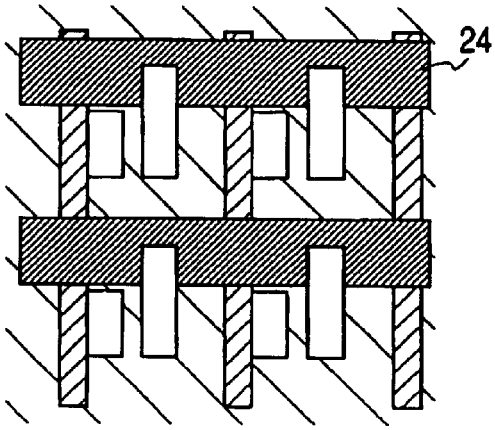
Figure 3D:
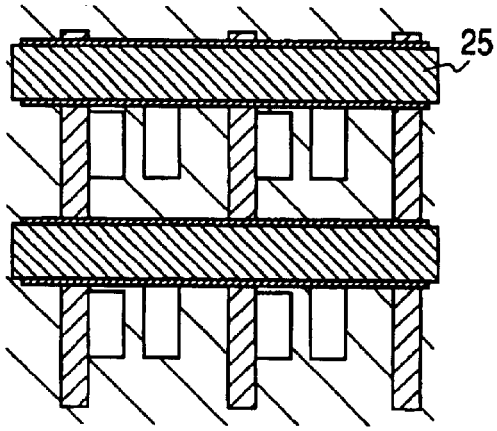

Then, paste prepared by mixing PbO which was the principal ingredient and glass binder was applied thereon by printing to produce an about 20 $\mu$m thick insulation layer 24 for insulating the Y-directional wires from X-directional wires, which will be described below. The insulation layer 24 was provided with a cut-out area for the device electrodes 22 of each electron-emitting device to allow the device electrodes to be connected to the corresponding X-directional wire (FIG. 3C).

(Step-d)

Thereafter, X-directional wires 25 were formed on the insulation layer 24 (FIG. 3D) in a manner as described above for the Y-directional wires 23. Each of the X-directional wires 25 was 300 $\mu$m wide and about 10 $\mu$m thick. Subsequently, an electroconductive film 26 of fine PdO particles was formed for each device.

More specifically, the electroconductive film 26 was produced by forming a Cr film on the substrate 1 carrying thereon the wires 23 and 25 by sputtering and then an opening having a contour corresponding to that of the electroconductive film 26 was formed through the Cr film for each device by photolithography.

Figure 3E:
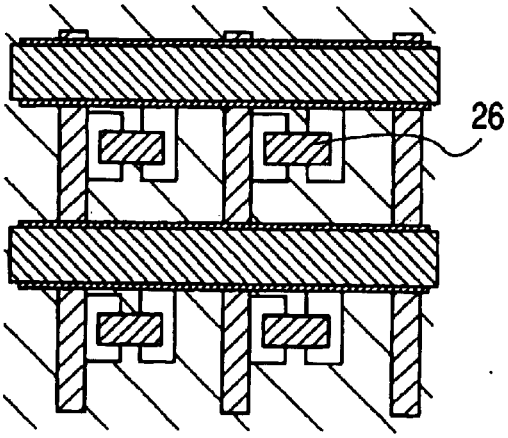

Thereafter, a solution of an organic Pd compound (ccp-4230: available from Okuno Pharmaceutical Co., Ltd.) was applied to the Cr film and baked at 300° C. for 12 minutes in the atmosphere to produce a film of fine PdO particles. Then the Cr film was removed by wet etching and the fine PdO particle film was lifted off to produce the electroconductive film 26 having the predetermined contour (FIG. 3E).

(Step-e)

Once again, paste prepared by mixing PbO which was the principal ingredient and glass binder was applied to the rear plate in the area other than those of the device electrodes 21, 22, the X- and Y-directional wires 25, 23 and the electroconductive films 26 (electron source region 2 in FIG. 1), which corresponds to the inside of the support frame 4 in FIG. 1.

(Step-f)

Figure 4:
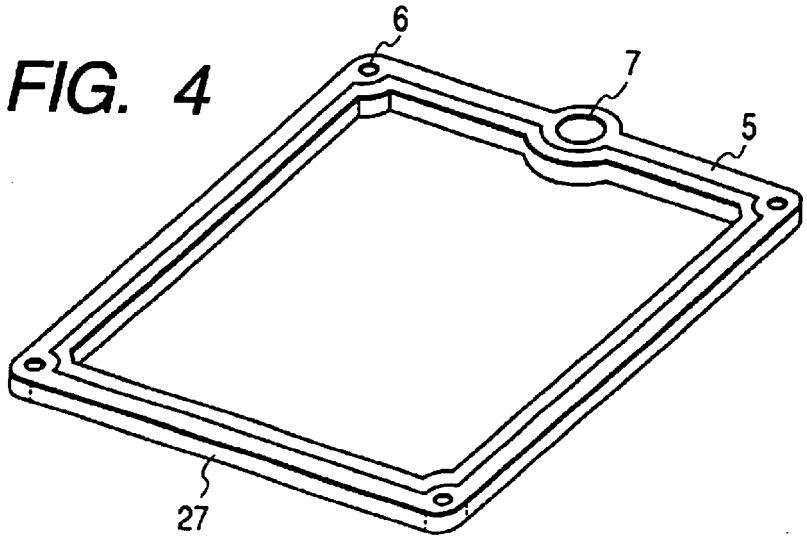
FIG. 4 is a schematic perspective view of the quartz plate and the low resistance electric conductor arranged thereon of an image-forming apparatus according to the invention.

Thereafter, Au paste was applied to a 0.5 mm thick frame of quartz glass having a profile substantially same as that of the low resistance electric conductor to be formed but having a width slightly greater than that of the latter as shown in FIG. 4. Then, the Au paste was baked to produce an Au low resistance electric conductor 5 that was 2 mm wide and about 100 $\mu$m thick. Note, however, that each of the four corners providing abutting sections 6 for the ground connection terminal was in the form of a quarter of a circle with a radius of 5 mm and the portion for forming a through hole 7 for the high voltage lead-in terminal had a circular profile with a diameter of 8 mm, through the center of which a through hole was bored to show a diameter of 4 mm. The low resistance electric conductor 5 was then plated on the rear plate with the through hole 7 aligned with the high voltage lead-in terminal and the glass paste was heat treated by produce the insulation layer and, at the same time, secure the quartz glass frame 27 carrying thereon the low resistance electric conductor 5 to the proper position.

Quartz glass was used for the frame 27 in order to provide a sufficient prevention of dielectric breakdown between the low resistance electric conductor 5 and the electron source drive wires 3-1, 3-2 and 3-3. Therefore, if it is possible to provide a sufficient dielectric withstand voltage by means of glass paste, the insulation layer may be made of glass paste and a low resistance electric conductor 5 may be made thereon.

(Step-g)

A support frame 4 was bonded to the rear plate by means of frit glass to secure a gap between the rear plate and the face plate 11 as shown in FIGS. 1 and 2A through 2C. At the same time, a getter 8 was rigidly secured to its proper position by means of frit glass. Then, an anti-charge film 14 was formed to show a sheet resistance of about $10^8$ Ω/□ by spray-coating a disperse solution of fine carbon particles onto the areas that make the inner surface of the vacuum envelope and then drying the solution.

(Step-h)

Then, a face plate was prepared by using a substrate of soda lime glass having an $SiO_2$ layer as in the case of the rear plate. An opening for connecting an exhaust pipe and a ground connection terminal lead-in port were formed by ultrasonic cutting. Thereafter, high voltage lead-in terminal abutting sections and wires for connecting them to the metal back were formed with Au and then black stripes and stripe-shaped fluorescent bodies were formed for the fluorescent film and subjected to a filming operation. Then, an A1 film was formed thereon to a thickness of about 20 $\mu$m by vacuum evaporation to produce a metal back. Subsequently, an anti-charge film 14 was formed by spray-coating a disperse solution of fine carbon particles onto the areas that make the inner surface of the vacuum envelope and then drying the solution. Of the produced film, the areas formed on the metal back has the effect of suppressing reflection of incident electron beams and hence preventing charge-ups from taking place due to reflected electrons that collide with the inner wall of the vacuum envelope.

(Step-i)

The support frame 4 bonded to the rear plate was then bonded to the face plate by means of frit glass. The ground connection terminal, the high voltage lead-in terminal and the exhaust pipe were bonded also at this stage of operation. The ground connection terminal and the high voltage lead-in terminal were prepared by forcing an Au-coated Ag rod into an insulator containing alumina as principal ingredient.

Note that the electron-emitting devices of the electron source and the fluorescent film of the face plate were carefully aligned for positional correspondence.

(Step-j)

The prepared image-forming apparatus was then connected to an exhausting equipment by way of an exhaust pipe to evacuate the inside of the envelope to a pressure level of $10^{-4}$ Pa or lower, when an energization forming process was started.

The energization forming process was conducted by applying a pulse voltage with a peak value gradually increasing with time as schematically illustrated in FIG. 5B to the electron-emitting devices on a row by row basis along the X-direction. The pulse width and the pulse interval were T1=1 msec and T2=10 msec respectively. During the energization forming process, an extra pulse voltage of 0.1 V was inserted into intervals of the forming pulse voltage in order to determine the resistance of the electron emitting device and the energization forming operation was terminated for a row when the resistance exceeded 1 MΩ. In this way, an energization forming operation was performed for all the rows to complete the process.

(Step-k)

Subsequently, the electron source was subjected to an activation process. Prior to this process, the inside of the vacuum envelope was further evacuated to a pressure level of less than $10^{-5}$ Pa by means of an ion pump, keeping the image-forming apparatus to 200° C. Subsequently, acetone was introduced into the vacuum envelope until the internal pressure rose to $1.3\times10^{-2}$ Pa. Then, a rectangular pulse voltage with a height of 16V was applied to the X-directional wires on a one by one basis. The pulse width and the pulse interval were 100 $\mu$sec. and 125 $\mu$sec. respectively. Thus, a pulse voltage was applied to each of the X-directional wires with a pitch of 10 msec. As a result of this process, a film containing carbon as principal ingredient was deposited on and around the electron-emitting region of each electron-emitting device to raise the device current If.

(Step-l)

Thereafter, a stabilization process was carried out. The inside of the vacuum envelope was evacuated once again by means of an ion pump for 10 hours, maintaining the image-forming apparatus to 200° C. This step was for removing molecules of organic substances remaining in the vacuum envelope to prevent any further growth of the deposited film containing carbon as principal ingredient and stabilize the performance of each electron-emitting device.

(Step-m)

After cooling the image-forming apparatus to room temperature, the ground connection terminal was connected to the ground and a pulse voltage was applied to the X-directional wires as in Step-k and additionally a voltage of 5 kV was applied to the image-forming member by way of the high voltage lead-in terminal to make the fluorescent film emit light. The application of the respective voltages to the X-directional wires and to the image-forming member was terminated after visually confirming that the fluorescent film was emitting light uniformly without any areas that were not emitting light or appeared very dark. Then, the exhaust pipe was hermetically sealed by heating and melting it. Thereafter, the image-forming apparatus was subjected to a getter process using high frequency heating to complete the entire manufacturing steps.

Another specimen of image-forming apparatus was prepared by following the above described steps and then the face plate was partly cut out to observe the impedance between the low resistance electric conductor and the ground, which was about 10 Ω. Then, impedance was observed once again after cutting the electric connection between the ground connection terminal and the ground to find out it was equal to about 1 MΩ, which represented the electric resistance between the low resistance electric conductor and the ground without the ground connection line.

Then, voltages were applied again to the electron source and the image-forming member of the image-forming apparatus of Example 1 respectively to make the image-forming member emit light. The voltage applied to the image-forming member was 6 kV.

Figure 6A:
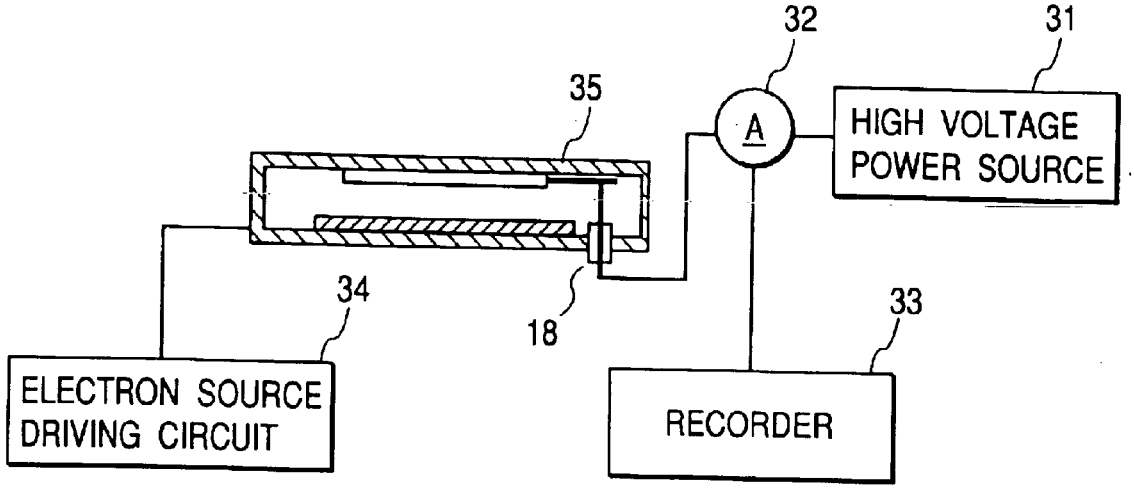
FIG. 6A is a schematic block diagram of a gauging system for verifying the effect of an image-forming apparatus according to the invention.

Although not shown in FIG. 6A, the peripheral portion of the face plate of the image-forming apparatus was secured to the ground by means of electroconductive rubber during the above observation so that substantially no electrolytic current flowed between the face plate and the support frame and between the support frame and the rear plate and the frit glass bonding them was prevented from degradation.

Figure 6B:
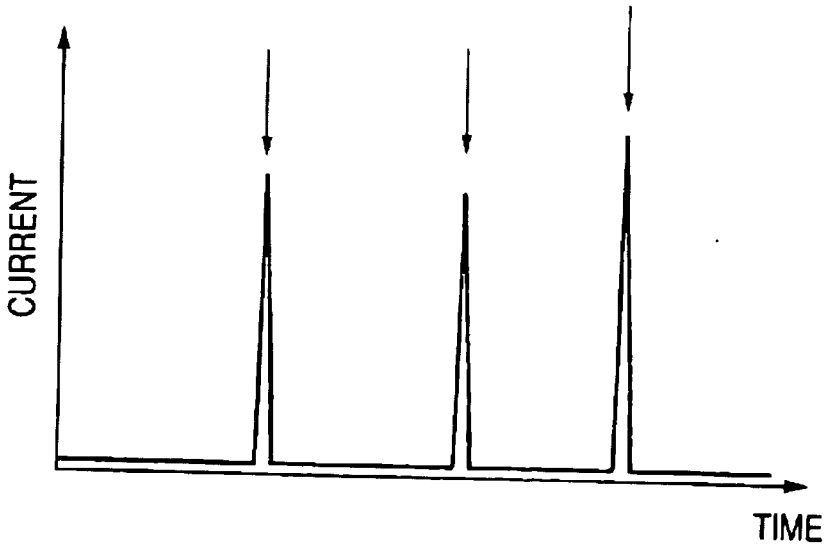
FIG. 6B is a graph schematically showing the electric current observed by using the gauging system of FIG. 6A.

The operation of driving the image-forming apparatus was observed by connecting an ammeter 32 between the high voltage source 31 and the high voltage lead-in terminal 18 as schematically illustrated in FIG. 6A to see electric discharges by way of the electric current flowing between them. In FIG. 6A, reference numerals 33, 34 and 35 denote respectively a recorder, an electron source drive circuit and the image-forming apparatus. The ammeter 32 normally detected only a very small electric current, which presumably represented a current mostly flowing through the anti-charge film 14 on the inner surface of the vacuum envelope of the image-forming apparatus 35, although peaks as indicated by arrows in FIG. 6B appeared occasionally to prove that electric discharges occurred in the vacuum envelope. Thus, the number of electric discharges can be determined by recording the electric current.

The operation of the above image-forming apparatus was observed continuously for 10 hours, during which six electric discharges were recorded and no flaws such as linear flaws were found in the displayed image.

EXAMPLE 2

An image-forming apparatus was prepared as in Example 1 except that the low resistance electric conductor 5 was made of graphite paste and then the performance of the prepared apparatus was observed in a manner as described above to find out that it operated as its counterpart of Example 1, in which the low resistance electric conductor was formed by baking Au. The electric resistance between the low resistance electric conductor of the apparatus and the ground was about 100 Ω and no substantial difference existed between the apparatus of Example 1 and that of this example.

EXAMPLE 3

Figure 7A:
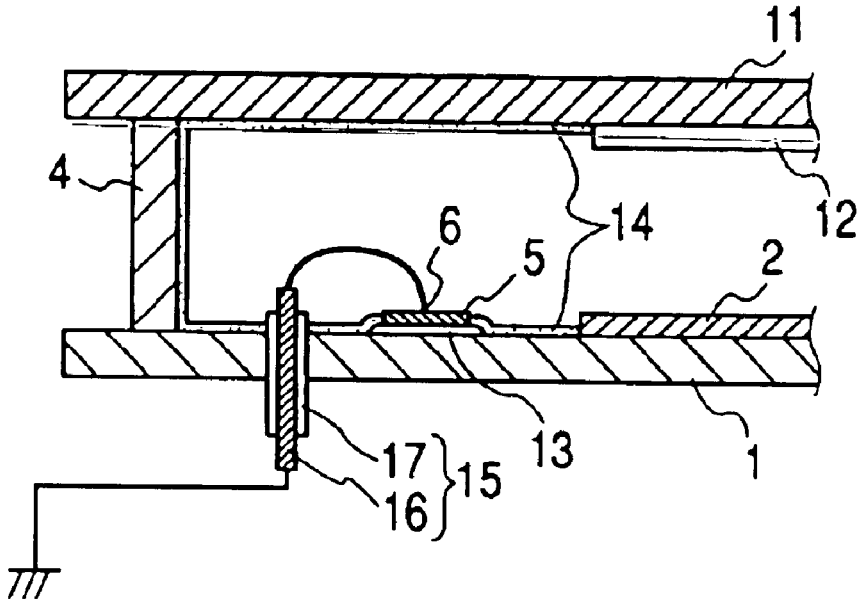
FIGS. 7A and 7B are schematic partial views of another embodiment of an image-forming apparatus according to the invention.
Figure 7B:
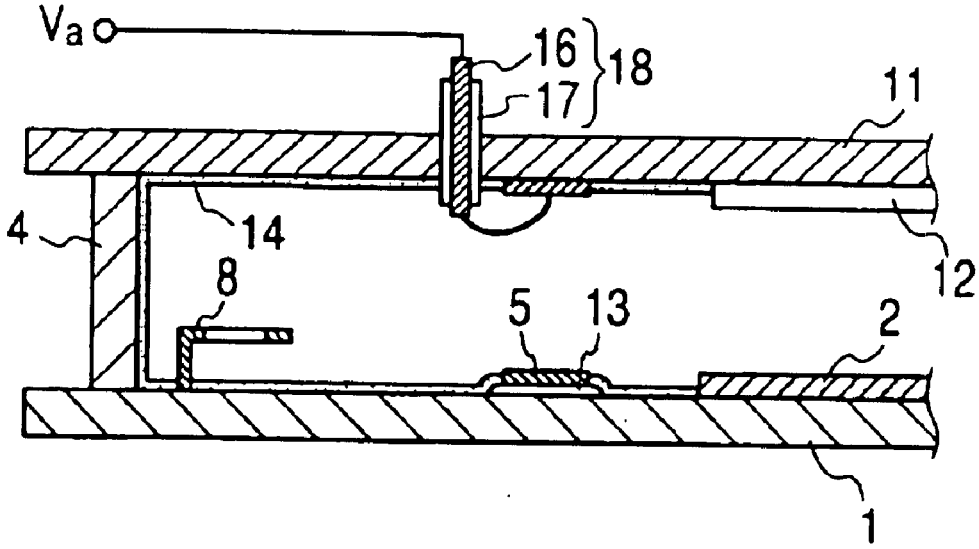

In the image-forming apparatus of Example 1, the ground connection terminal was introduced into the vacuum envelope from the face plate side and the high voltage lead-in terminal was introduced into it from the rear plate side. To the contrary, in this example, the ground connection terminal was introduced into the vacuum envelope from the rear plate side and the high voltage lead-in terminal was introduced into it from the face plate side as schematically shown in FIGS. 7A and 7B. When observed, the prepared image-forming apparatus operated as its counterpart of Example 1. With the arrangement of this example, the lateral side of the insulator 17 of the high voltage terminal was free from high voltages that could give rise to electric discharges and hence did not require the use of a low resistance electric conductor for it.

EXAMPLE 4

An image-forming apparatus was prepared by following the steps of Example 1 except that no anti-charge film was formed in Step-h. When the apparatus was driven by applying a voltage to the image-forming member as in Example 1, a total of fifteen electric discharges were observed without damages to the electron-emitting devices.

EXAMPLE 5

Figure 12A:
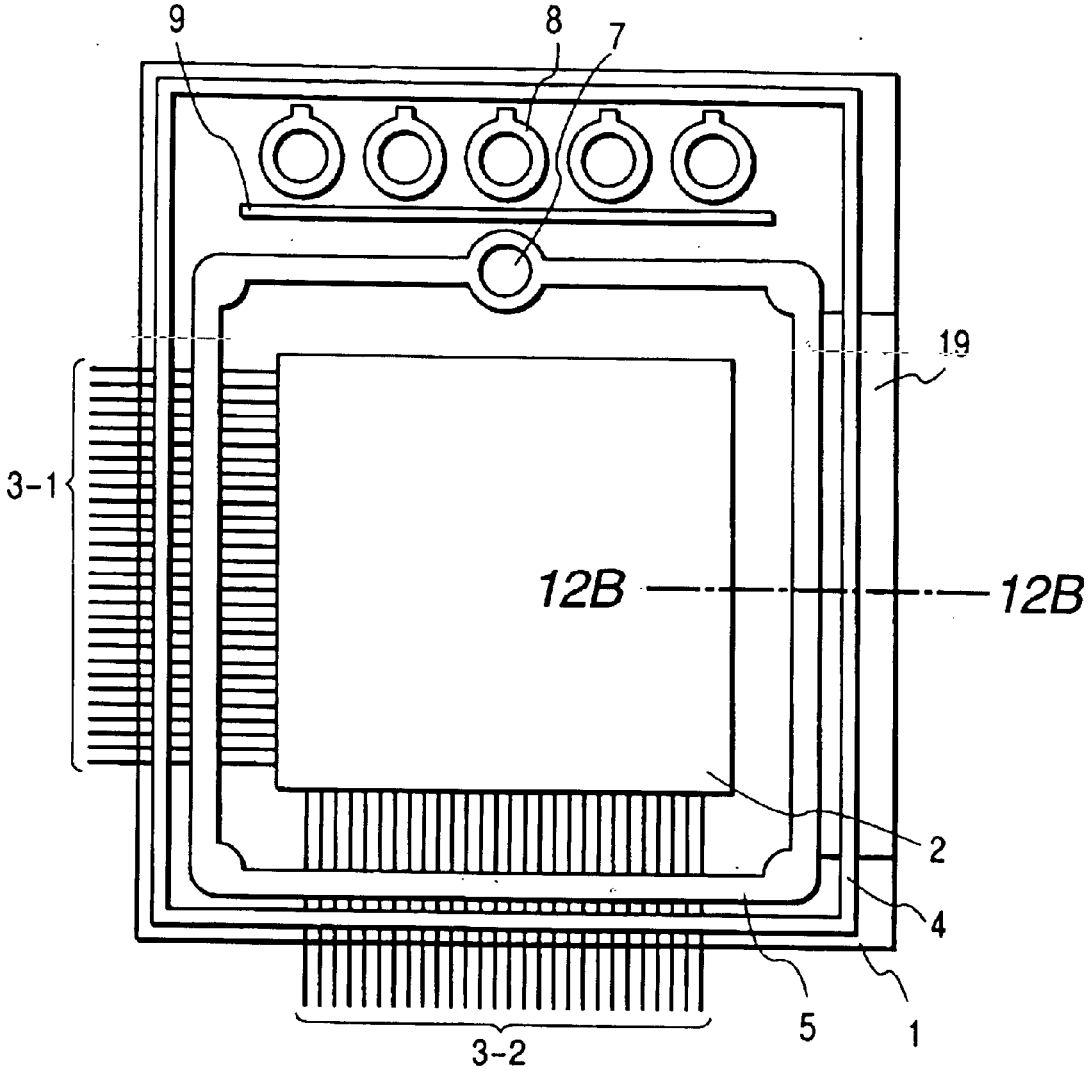
FIGS. 12A and 12B are a plan view and a partial cross sectional view schematically showing another embodiment of an image-forming apparatus according to the invention.
Figure 12B:
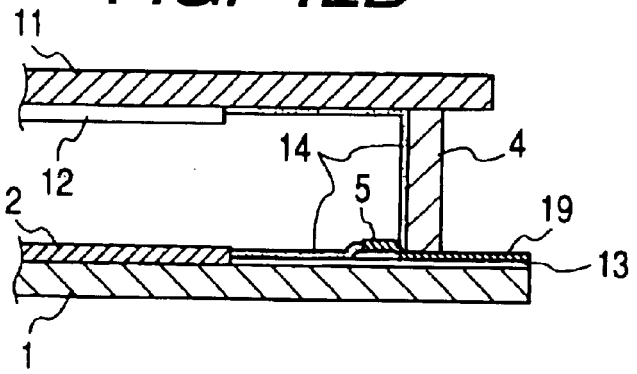

FIG. 12A is a schematic plan view of the image-forming apparatus prepared in this example, showing the inside by removing the face plate. FIG. 12B is a schematic cross sectional view taken along line 12B—12B in FIG. 12A. In FIGS. 12A and 12B, reference numeral 19 denotes a ground connection terminal made of electroconductive film and prepared by way of a process similar to the one for preparing the electron source drive wires 3-1, 3-2 and 3-3 and the low resistance electric conductor 5. The use of a wide electroconductive film sufficiently reduced the electric resistance of this area. Otherwise, the image-forming apparatus of this example was identical with its counterpart of Example 1 and operated similarly, although the X-directional wires were drawn out of the vacuum envelope only at an end thereof so that the wires denoted by reference symbol 3—3 and the ground connection terminal 19 were not layered in the apparatus of this example.

With this arrangement, while grounding wires were fitted to the ground connection terminal 19 at an end of the rear plate, requiring an extra space, no through hole was required in the face plate or the rear plate for arranging the ground connection terminal so that the overall configuration of the image-forming apparatus and hence the process of manufacturing it was simplified.

EXAMPLE 6

Figure 13:
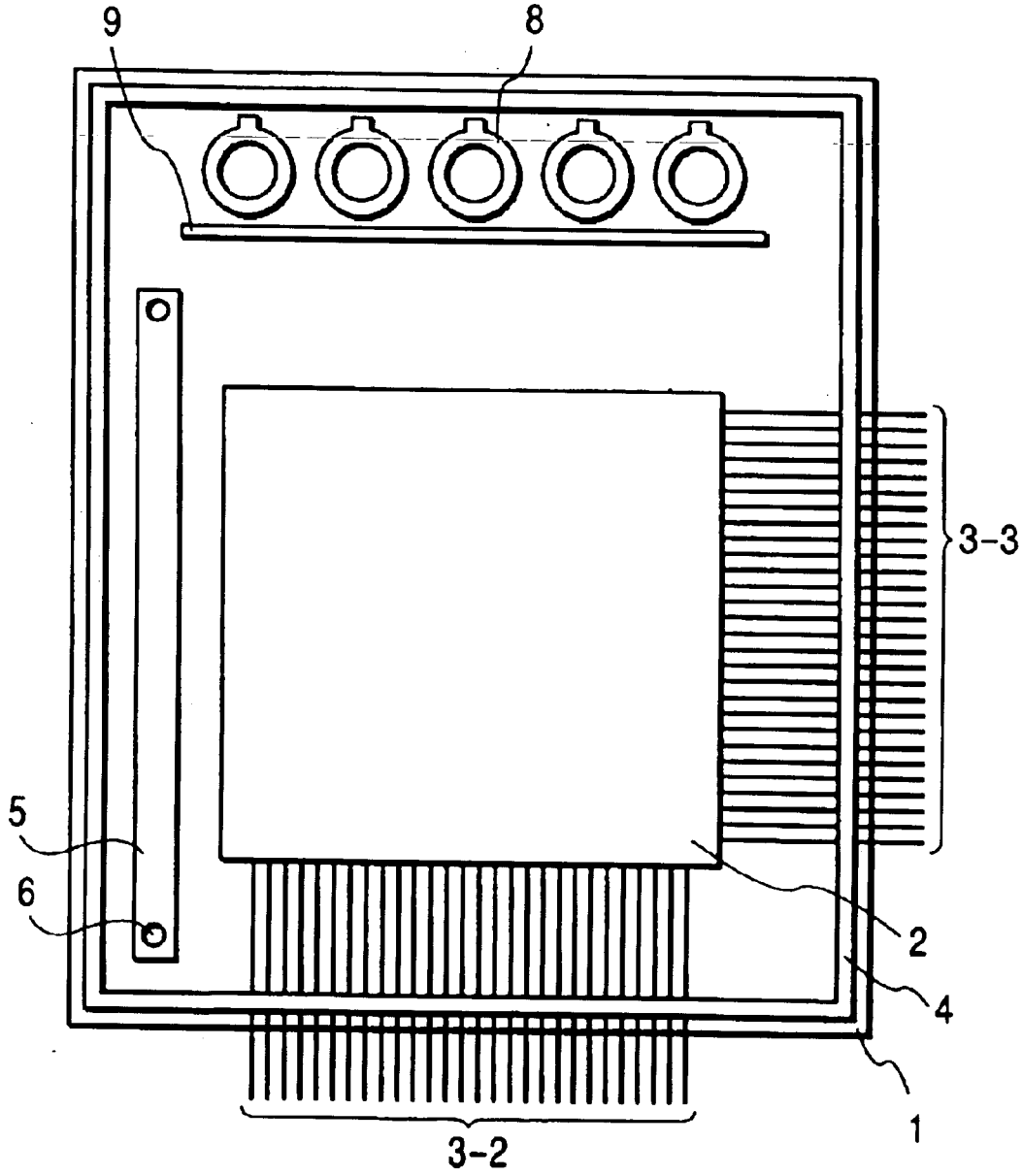
FIG. 13 is a schematic plan view of still another embodiment of an image-forming apparatus according to the invention.

In this example, the low resistance electric conductor was arranged only on a lateral side of the electron source as schematically shown in FIG. 13. A through hole was formed in the face plate for the high voltage lead-in terminal as in Example 3. Otherwise, the apparatus of this example was identical with its counterpart of Example 1. For driving the electron source, the X-directional wires and the Y-directional wires operated as the negative side and the positive side respectively and the electron-emitting devices and the above-mentioned wires were connected in a manner as shown in FIG. 3E so that the momentum of electrons emitted from the electron source had a component directed from right to left in FIG. 13. Therefore, electrons scattered by the image-forming member were assumed to be apt to collide with the left lateral side of the vacuum envelope and hence electric discharges could easily occur there. This was the reason why the low resistance electric conductor was arranged only on the left side of the electron source as shown in FIG. 13 to avoid damages to the electron-emitting devices.

Note that the effect of this example can be achieved by using transversal field emission type electron-emitting devices as electron-emitting devices of an image-forming apparatus according to the invention. Also note that the low resistance electric conductor may be arranged any limited areas that are apt to give rise to electric discharges for some reason or another.

EXAMPLE 7

Figure 14:
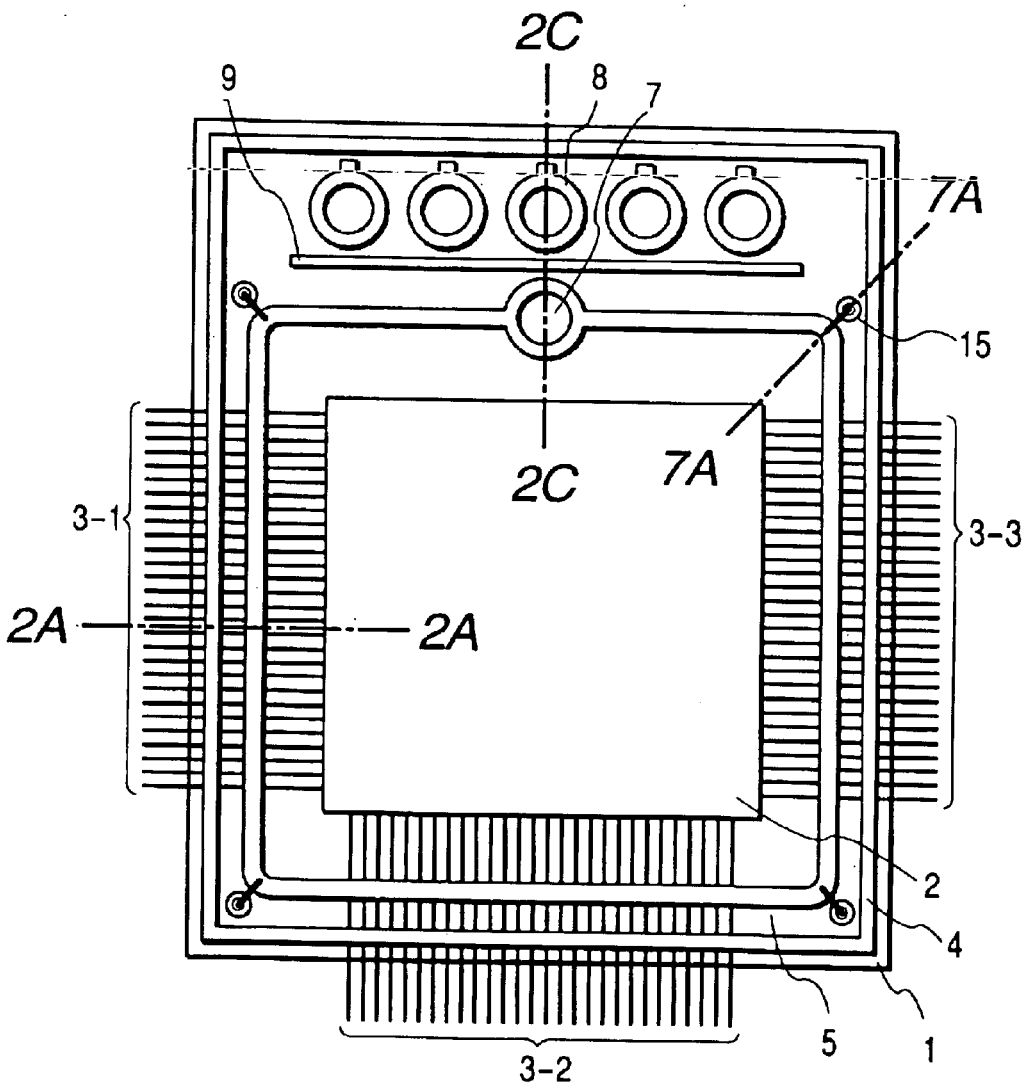
FIG. 14 is a schematic plan view of still another embodiment of an image-forming apparatus according to the invention.

In this example, the high voltage lead-in terminal 18 and the ground connection terminal 15 were both introduced through the rear plate. FIG. 14 is a schematic plan view of the constitution of this example, showing the inside of the envelope by removing the face plate. The cross-sections taken along lines 2A—2A, 2C—2C and 7A—7A are shown in FIGS. 2A, 2C and 7A, respectively. The conductor rod 16 of the ground connection terminal 15 was connected to the low resistance electric conductor 5. As shown in FIG. 14, all the high voltage terminals to be used for the ground connection terminal through which a large current could flow and the high voltage terminal to be subjected to a high voltage were drawn out to the rear side of the image-forming apparatus to the advantage of safeguarding the user. Additionally, the image-forming apparatus was free from projections to provide an advantage in terms of appearance and an unobstructed wide viewing angle. Finally, this arrangement was also advantageous in that the drive circuit and other components could be arranged on the rear side of the rear plate to reduce the height of the image-forming apparatus.

It should be understood, however, that the high voltage lead-in terminal and the ground connection terminal may be arranged arbitrarily at suitable positions depending on the configuration or structure of the image-forming apparatus, without incurring any limitation to the above-illustrated structure.

While the present invention is described in terms of the use of surface conduction electron-emitting devices for the electron source, the present invention is not limited thereto by any means and the surface conduction electron-emitting devices may be replaced by field emission type electron-emitting devices, semiconductor electron-emitting devices and electron-emitting devices of some other type.

Furthermore, while the rear plate of the image-forming apparatus operated as the substrate of the electron source in any of the above examples, they might alternatively be prepared separately so that the substrate could be secured to the rear plate after preparing the electron source.

The above described members of an image-forming apparatus according to the invention can be modified without departing from the spirit and the scope of the present invention. The row-directional wires 3-1 and 3-2 shown in FIG. 1 can be drawn out only from a side.

Thus, an image-forming apparatus according to the invention is effectively protected against degradation of and damages to the electron source and the electron source drive circuit if electric discharges occur within the vacuum envelope of the apparatus and hence operates reliably.

Therefore, the members of the vacuum envelope of an image-forming apparatus according to the invention are protected against cracks that can be produced as a result of electric discharges occurring there.

Finally, according to the invention, an image-forming apparatus comprising an electron source can be made very thin.

What is claimed is:

1. An image-forming apparatus comprising an envelope;

an electron source and an image-forming member arranged within said envelope;

an electron source drive circuit;

an electroconductive member arranged on an inner wall surface of said envelope between said electron source and said image forming member; and an electric current flow path A extending between said electroconductive member and the ground without passing through said electron source and said drive circuit, wherein said electric current flow path A has a resistance lower than the resistance of another electric current flow path B extending between said electroconductive member and the ground by way of said electron source or said drive circuit, and wherein said envelope carries an anti-charge film arranged on said inner wall surface thereof.

2. An image-forming apparatus according to claim 1, wherein said anti-charge film is electrically connected to said electroconductive member.

3. An image-forming apparatus comprising an envelope;

an electron source and an image-forming member arranged within said envelope;

an electron source drive circuit;

an electroconductive member arranged on an inner wall surface of said envelope between said electron source and said image forming member; and an electric current flow path A extending between said electroconductive member and the ground without passing through said electron source and said drive circuit, wherein said electric current flow path A has a resistance lower than the resistance of another electric current flow path B extending between said electroconductive member and the ground by way of said electron source or said drive circuit, and wherein said envelope carries an electroconductive film having a sheet resistance between $10^8$ Ω/□ and $10^{10}$ Ω/□ on said inner wall surface thereof.

4. An image-forming apparatus according to claim 3, wherein said electroconductive film is electrically connected to said electroconductive member.

5. An image-forming apparatus comprising:

an envelope;

an electron source and an image-forming member arranged within said envelope;

an electron source drive circuit;

an electroconductive member arranged on an inner wall surface of said envelope between said electron source and said image forming member; and an electric current flow path A extending between said electroconductive member and the ground without passing through said electron source and said drive circuit, wherein said electric current flow path A has a resistance lower than the resistance of another electric current flow path B extending between said electroconductive member and the ground by way of said electron source or said drive circuit, and wherein said electron source is entirely surrounded by said electroconductive member.

6. An image-forming apparatus comprising:

an envelope;

an electron source and an image-forming member arranged within said envelope;

an electron source drive circuit;

an electroconductive member arranged on an inner wall surface of said envelope between said electron source and said image forming member; and an electric current flow path A extending between said electroconductive member and the ground without passing through said electron source and said drive circuit, wherein said electric current flow path A has a resistance lower than the resistance of another electric current flow path B extending between said electroconductive member and the ground by way of said electron source or said drive circuit, said electric current flow path A has a conductor terminal abutting against said electroconductive member; and wherein said conductor terminal is drawn out of said envelope through a substrate side thereof where said image-fanning member is arranged.

7. An image-forming apparatus comprising:

an envelope;

an electron source and an image-forming member arranged within said envelope;

an electron source drive circuit;

an electroconductive member arranged on an inner wall surface of said envelope between said electron source and said image forming member; and an electric current flow path A extending between said electroconductive member and the ground without passing through said electron source and said drive circuit, wherein said electric current flow path A has a resistance lower than the resistance of another electric current flow path B extending between said electroconductive member and the ground by way of said electron source or said drive circuit, said image-forming member is arranged opposite to said electron source and said electroconductive member is arranged on a substrate side of said envelope where said electron source is arranged, and said image-forming member has an accelerator electrode for accelerating the electrons emitted from said electron source and a voltage applying terminal of said accelerator electrode is drawn out of said envelope through a substrate side thereof where said electron source is arranged.

8. An image-forming apparatus according to claim 7, wherein said electric current flow path A has a conductor terminal abutting against said electroconductive member.

9. An image-forming apparatus according to claim 7, wherein said voltage applying terminal of said accelerator electrode comprises a conductor and an insulator, said insulator covering part of said conductor.

10. An image-forming apparatus according to claim 9, wherein said electroconductive member is arranged surrounding said voltage applying terminal.

11. An image-forming apparatus comprising:

an envelope;

an electron source and an image-forming member arranged within said envelope;

an electron source drive circuit an electroconductive member arranged on an inner wall surface of said envelope between said electron source and said image forming member; and an electric current flow path A extending between said electroconductive member and the ground without passing through said electron source and said drive circuit, wherein said electric current flow path A has a resistance lower than the resistance of another electric current flow path B extending between said electroconductive member and the ground by way of said electron source or said drive circuit, said image-forming member is arranged opposite to said electron source and said electroconductive member is arranged on a substrate side of said envelope where said electron source is arranged, and said image-forming member has an accelerator electrode for accelerating the electrons emitted from said electron source and a voltage applying terminal of said accelerator electrode is drawn out of said envelope through a substrate side thereof where said image-forming member is arranged.

12. An image-forming apparatus comprising:

an envelope;

an electron source and an image-forming member arranged within said envelope;

an electron source drive circuit;

an electroconductive member arranged on an inner wall surface of sad envelope between said electron source and said image forming member; and an electric current flow path A extending between said electroconductive member and the ground without passing through said electron source and said drive circuit, wherein said electric current flow path A has a resistance lower than the resistance of another electric current flow path B extending between said electroconductive member and the ground by way of said electron source or said drive circuit, said image-forming member is arranged opposite to said electron source and said electroconductive member is arranged on a substrate side of said envelope where said electron source is arranged, and wherein said envelope carries an anti-charge film arranged on said inner wall surface thereof.

13. An image-forming apparatus according to claim 12, wherein said anti-charge film is electrically connected to said electroconductive member.

14. An image-forming apparatus, comprising an envelope;

an electron source and an image-forming member arranged within said envelope, an electron source drive circuit;

an electroconductive member arranged on an inner wall surface of said envelope between said electron source and said image-forming member; and an electric current flow path A extending between said electroconductive member and the ground without passing through said electron source and drive circuit, wherein said electric current flow path A has a resistance lower than the resistance of another electric current flow path B extending between said electroconductive member and the ground by way of said electron source or said drive circuit, said image-forming member is arranged opposite to said electron source and said electroconductive member is arranged on a substrate side of said envelope where said electron source is arranged, and said envelope carries an electroconductive film having a sheet resistance between $10^8$ Ω/□ and $10^{10}$ Ω/□ on said inner wall surface thereof.

15. An image-forming apparatus according to claim 14, wherein said electroconductive film is electrically connected to said electroconductive member.

16. An image-forming apparatus according to any one of claims 1, 3, 5, 6, 7, 11, 12 and 14, wherein said electric current flow path A has a resistance not greater than 1/10 of the resistance of said electric current flow path B.

17. An image-forming apparatus according to any one of claims 1, 3, 5, 6, 7, 11, 12 and 14, wherein said electron-emitting devices are cold cathode devices.

18. An image-forming apparatus according to claim 17, wherein said cold cathode devices are surface conduction electron-emitting devices.

19. An image-forming apparatus comprising:

an envelope having an inner wall surface;

an electron source and an image-forming member arranged opposite to each other within said envelope;

an electron source drive circuit;

an electroconductive member arranged on the inner wall surface of said envelope between said electron source and said image forming member, said electroconductive member being apart from said electron source;

a ground connection terminal abutting said electroconductive member and connected to the ground, said ground connection terminal having a resistance A; and an anti-charge film arranged on at least put of the inner wall surface of said envelope between said electron source and said electroconductive member and connected to the electron source and the electroconductive member, said anti-charge film having a resistance B, wherein the resistance A of said ground connection terminal is lower than the resistance B of said anti-charge film.

20. An image-forming apparatus comprising:

an envelope having an inner wall surface;

an electron source and an image-forming member arranged opposite to each other within said envelope;

an electron source drive circuit;

an electroconductive member arranged on the inner wall surface of said envelope between said electron source and said image forming member, said electroconductive member surrounding and being apart from said electron source; and a ground connection terminal abutting said electroconductive member and connected to the ground, wherein a resistance A of said ground connection terminal is lower than a resistance B between said electron source and said electroconductive member.

21. An image-forming apparatus comprising:

an envelope having an inner wall surface;

an electron source and an image-forming member arranged opposite to each other within said envelope;

an electron source drive circuit;

an electroconductive member arranged on the inner wall surface of said envelope between said electron source and said image forming member, said electroconductive member surrounding and being apart from said electron source;

a ground connection terminal abutting said electroconductive member and connected to the ground, said ground connection terminal having a resistance A; and an anti-charge film arranged on at least part of the inner wall surface of said envelope between said electron source and said electroconductive member and connected to the electron source and the electroconductive member, said anti-charge film having a resistance B, wherein the resistance A of said ground connection terminal is lower than the resistance B of said anti-charge film.

22. An image-forming apparatus comprising:

an envelope having an inner wall surface;

an electron source and an image-forming member arranged opposite to each other within said envelope;

an electron source drive circuit;

an electroconductive member arranged on the inner wall surface of said envelope between said electron source and said image forming member, said electroconductive member being apart from said electron source;

a connection terminal connecting said electroconductive member to a reference potential, said connection terminal having a first resistance, and an anti-charge film arranged on at least part of the inner wall surface of said envelope between said electron source and said electroconductive member and connected to the electron source and the electroconductive member, said anti-charge film having a second resistance, wherein the first resistance is lower than the second resistance.

23. An image-forming apparatus according to claim 22, wherein said envelope has a first substrate arranging thereon said electron source and a second substrate arranging thereon said image-forming member, and said electroconductive member is arranged on said first substrate.

24. An image-forming apparatus comprising:

an envelope having an inner wall surface;

an electron source and an image-forming member arranged opposite to each other within said envelope;

an electron source drive circuit;

an electroconductive member arranged on the inner wall surface of said envelope between said electron source and said image forming member, said electroconductive member surrounding and being apart from said electron source, and a connection terminal connecting said electroconductive member to a reference potential, wherein a resistance A of said connection terminal and a resistance B between said electron source and said electroconductive member satisfy a relation of $A<B$.

25. An image-forming apparatus according to claim 24, wherein said envelope has a first substrate arranging thereon said electron source and a second substrate arranging thereon said image-forming member, and said electroconductive member is arranged on said first substrate.

26. An image-forming apparatus comprising:

an envelope having an inner wall surface;

an electron source and an image-forming member arranged opposite to each other within said envelope;

an electron source drive circuit;

an electroconductive member arranged on the inner wall surface of said envelope between said electron source and said image forming member, said electroconductive member surrounding and being apart from said electron source;

a connection terminal connecting said electroconductive member to a reference potential, said connection terminal having a first resistance; and an anti-charge film arranged on at least part of the inner wall surface of said envelope between said electron source and said electroconductive member and connected to the electron source and the electroconductive member, said anti-charge film having a second resistance, wherein the first resistance is lower than the second resistance.

* * * * *

UNITED STATES PATENT AND TRADEMARK OFFICE

CERTIFICATE OF CORRECTION

PATENT NO. : 6,787,983 B2 
DATED : September 7, 2004
INVENTOR(S) : Masato Yamanobe et al.

It is certified that error appears in the above-identified patent and that said Letters Patent is hereby corrected as shown below:

Title page,
Item [*] Notice, please insert the following:
-- CPA: This patent issued on a continued prosecution application filed under 37 CFR 1.53(d), and is subject to the twenty year patent term provisions of 35 U.S.C. 154 (a)(2). --.
Item [56], References Cited, FOREIGN PATENT DOCUMENTS,
"JP 31-196455 8/1991" should read -- JP 3-196455 8/1991 --.

Column 11,
Line 12, "electroconductive" should read -- electroconductive film --.
Line 52, "$1.3\times10^{6}$ Pa" should read -- $1.3\times10^{-8}$ Pa --.
Line 53, "$1.3\times10^{8}$ Pa." should read -- $1.3\times10^{-6}$ Pa. --,
Line 65, "$1\times10^{5}$ Pa" should read -- $1\times10^{-5}$ Pa --, and "$1.3\times 10^{6}$ Pa." should read -- $1.3\times 10^{-6}$ Pa --.

Column 20,
Line 39, "image-fanning" should read -- image-forming --.

Column 21,
Line 15, "circuit" should read -- circuit; --.
Line 45, "of sad" should read -- said --.

UNITED STATES PATENT AND TRADEMARK OFFICE

CERTIFICATE OF CORRECTION

PATENT NO. : 6,787,983 B2
DATED : September 7, 2004
INVENTOR(S) : Masato Yamanobe et al.

It is certified that error appears in the above-identified patent and that said Letters Patent is hereby corrected as shown below:

Column 22,
Line 2, “envelope,” should read -- envelope; --.
Line 49, “put of” should read -- part of --.

Signed and Sealed this

Eleventh Day of January, 2005

JON W. DUDAS
*Director of the United States Patent and Trademark Office*